US010706858B2

(12) United States Patent
Lecomte et al.

(10) Patent No.: US 10,706,858 B2
(45) Date of Patent: Jul. 7, 2020

(54) ERROR CONCEALMENT UNIT, AUDIO DECODER, AND RELATED METHOD AND COMPUTER PROGRAM FADING OUT A CONCEALED AUDIO FRAME OUT ACCORDING TO DIFFERENT DAMPING FACTORS FOR DIFFERENT FREQUENCY BANDS

(71) Applicant: Fraunhofer-Gesellschaft zur Foerderung der angewandten Forschung e.V., Munich (DE)

(72) Inventors: Jérémie Lecomte, Santa Clara, CA (US); Adrian Tomasek, Zirndorf (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 132 days.

(21) Appl. No.: 16/123,581

(22) Filed: Sep. 6, 2018

(65) Prior Publication Data

US 2019/0005966 A1 Jan. 3, 2019

Related U.S. Application Data

(63) Continuation of application No. PCT/EP2017/055106, filed on Mar. 3, 2017.

(30) Foreign Application Priority Data

Mar. 7, 2016 (EP) ..... 16159033
May 25, 2016 (EP) ..... 16171443

(51) Int. Cl.
*G10L 19/00* (2013.01)
*G10L 19/005* (2013.01)
(Continued)

(52) U.S. Cl.
CPC ..... *G10L 19/005* (2013.01); *G10L 19/0204* (2013.01); *G10L 19/028* (2013.01);
(Continued)

(58) Field of Classification Search
CPC ..... G10L 19/00
See application file for complete search history.

(56) References Cited

U.S. PATENT DOCUMENTS 6,675,054 B1 1/2004 Ruberg
8,068,926 B2 * 11/2011 Andersen ..... H04M 3/18 700/94
(Continued)

FOREIGN PATENT DOCUMENTS

EP 0 747 884 11/1996
EP 2 922 056 9/2015
(Continued)

OTHER PUBLICATIONS

3GPP TS 26.402 (Release 11): "Enhanced aacPlus General Audio Codec; Additional Decoder Tools"; Sep. 2012.
(Continued)

*Primary Examiner* — Daniel Abebe
(74) *Attorney, Agent, or Firm* — Dicke, Billig & Czaja, PLLC

(57) ABSTRACT

There is provided an error concealment unit, method, and computer program for providing an error concealment audio information for concealing a loss of an audio frame in an encoded audio information. In one embodiment, the error concealment unit is configured to provide an error concealment audio information using a frequency domain concealment based on a properly decoded audio frame preceding a lost audio frame. The error concealment unit is configured to fade out a concealed audio frame out according to different damping factors for different frequency bands.

43 Claims, 16 Drawing Sheets

(51) Int. Cl.

| | |
|---|---|
| ***G10L 19/02*** | (2013.01) |
| ***G10L 19/028*** | (2013.01) |
| ***G10L 19/032*** | (2013.01) |
| ***G10L 25/21*** | (2013.01) |
| *G10L 25/18* | (2013.01) |

(52) U.S. Cl.
CPC ..... *G10L 19/032* (2013.01); *G10L 25/21* (2013.01); *G10L 25/18* (2013.01)

(56) References Cited

U.S. PATENT DOCUMENTS

| | | | | |
|---|---|---|---|---|
| 8,397,117 | B2 * | 3/2013 | Laaksonen | G10L 19/005 714/747 |
| 8,478,587 | B2 | 7/2013 | Kawamura et al. | |
| 9,053,702 | B2 | 6/2015 | Rajendran et al. | |
| 10,115,402 | B2 | 10/2018 | Tsutsumi et al. | |
| 10,262,662 | B2 | 4/2019 | Lecomte et al. | |
| 2007/0282601 | A1 | 12/2007 | Li | |
| 2010/0017200 | A1 | 1/2010 | Oshikiri et al. | |
| 2010/0115370 | A1 | 5/2010 | Laaksonen et al. | |
| 2010/0195490 | A1 | 8/2010 | Nakazawa et al. | |
| 2011/0007827 | A1 * | 1/2011 | Virette | G10L 19/005 375/259 |
| 2015/0142452 | A1 * | 5/2015 | Sung | G10L 19/025 704/500 |
| 2015/0255074 | A1 | 9/2015 | Jeong et al. | |

FOREIGN PATENT DOCUMENTS

| | | |
|---|---|---|
| JP | 2015-534115 | 11/2015 |
| RU | 2328775 | 7/2008 |
| RU | 2488897 | 7/2013 |
| WO | 2008/151408 | 12/2008 |
| WO | 2008/126347 | 7/2010 |
| WO | 2009/008220 | 9/2010 |
| WO | 2013/106181 | 7/2013 |
| WO | 2012/070370 | 5/2014 |
| WO | 2014/123471 | 8/2014 |
| WO | 2014/202535 | 12/2014 |
| WO | 2014/202539 | 12/2014 |
| WO | 2015/063044 | 5/2015 |
| WO | 2015/063045 | 5/2015 |

OTHER PUBLICATIONS

3GPP TS 26.447 version 13.0.0 (Release 13): Codec for Enhanced Voice Services (EVS); Error Concealment of Lost Packets, Dec. 2015.

AAC-ELD Standard: http://www.iso.org/iso/iso_catalogue/catalogue_tc/catalogue_detail.htm?csnumber=46457; Revised by ISO/IEC 14496-3, 2009.

J. Lecomte, et al.: "Enhanced Time Domain Packet Loss Concealment in Switched Speech/Audio Codec"; IEEE ICASSP, Brisbane, Australia, Apr. 2015, pp. 5922-5926; XP055245261.

Recommendation ITU-T G. 719: Section 8.6, Telecommunication Standardization Sector of ITU; Low Complexity, Full-Band Audio Coding for High-Quality, Conversational Applications, Jun. 2008.

Recommendation ITU-T G. 729.1: Section 7.6.1, Telecommunication Standardization Sector of ITU; G. 729-Based Embedded Variable Bit-Rate Coder An 8-32 kbit/s Scalable Wideband Coder Bitstream Interoperable with g. 729; May 2006.

Akio Ando, et al. "A Method for Automatic Measurement of Speech Rate", Acoustical Society of Japan Lecture Papers, Mar. 1995, p. 126-126.

* cited by examiner

ERROR CONCEALMENT UNIT, AUDIO DECODER, AND RELATED METHOD AND COMPUTER PROGRAM FADING OUT A CONCEALED AUDIO FRAME OUT ACCORDING TO DIFFERENT DAMPING FACTORS FOR DIFFERENT FREQUENCY BANDS

CROSS-REFERENCE TO RELATED APPLICATIONS

This application is a continuation of copending International Application No. PCT/EP2017/055106, filed Mar. 3, 2017, which is incorporated herein by reference in its entirety, and additionally claims priority from European Application No. 16159033.6, filed Mar. 7, 2016, and from European Application No. 16171443.1, filed May 25, 2016, which are also incorporated herein by reference in their entirety.

BACKGROUND OF THE INVENTION

Embodiments according to the invention create error concealment units for providing an error concealment audio information for concealing a loss of an audio frame or more audio frames in an encoded audio information.

Embodiments according to the invention create audio decoders for providing a decoded audio information on the basis of an encoded audio information, the decoders comprising error concealment units.

Some embodiments according to the invention create methods for providing an error concealment audio information for concealing a loss of an audio frame in an encoded audio information.

Some embodiments according to the invention create computer programs for performing one of said methods.

Some embodiments are related to a usage of an adaptive damping factor for frequency domain audio codecs.

In recent years there is an increasing demand for a digital transmission and storage of audio contents. However, audio contents are often transmitted over unreliable channels, which brings along the risk that data units (for example, packets) comprising one or more audio frames (for example, in the form of an encoded representation, like, for example, an encoded frequency domain representation or an encoded time domain representation) are lost. In some situations, it would be possible to request a repetition (resending) of lost audio frames (or of data units, like packets, comprising one or more lost audio frames). However, this would typically bring a substantial delay, and would therefore entail an extensive buffering of audio frames. In other cases, it is hardly possible to request a repetition of lost audio frames.

In order to obtain a good, or at least acceptable, audio quality given the case that audio frames are lost without providing extensive buffering (which would consume a large amount of memory and which would also substantially degrade real time capabilities of the audio coding) it is desirable to have concepts to deal with a loss of one or more audio frames. In particular, it is desirable to have concepts which bring along a good audio quality, or at least an acceptable audio quality, even in the case that audio frames are lost.

In the past, some error concealment concepts have been developed, which can be employed in different audio coding concepts. A conventional concealment technique in advanced audio codec (AAC) is noise substitution. It operates in the frequency domain and is suited for noisy and music items.

Fade out techniques have also been developed for reduce the intensity of the substituting frames (or spectral values). These techniques are often based on scaling the substituting frame by a predetermined coefficient (damping factor). Normally, the damping factor is represented as a value between 0 and 1: the lower the damping factor, the stronger the fade out.

In case of packet losses, speech and audio codecs usually fades towards zero or background noise to prevent annoying repetition artefacts. In G.719 [1] for example, the synthesized signal are decreasingly scaled with a factor 0.5 and then used as the reconstructed transform coefficients for the current frame. For all AAC family decoders like [2], the concealed spectrum is faded out with a constant damping factor equal to $\sqrt{0.5}\cong 0.7071$, when no additional delay is allowed. This damping factor is applied on the complete spectrum regardless on the signal characteristics.

However, especially for speech or transient signals, such a fade out technique is not completely satisfactory. When the first lost frame is right after a word end, the noise substitution will imply the repetition of the previous properly decoded audio frame, i.e. the frame in which the word is ended: a useless part of speech (carrying no information) will be repeated, implying annoying post echoes. See, for example, FIG. 10 (with echo) in comparison with FIG. 11 (where no echo is present). FIGS. 10 and 11 represent frequency in ordinate and time in abscissa (in hundred ms or hms).

This echo is a direct, unavoidable consequence of the repetition of the properly decoded audio frame.

It would be of advantage to overcome such a technical impairment. G.729.1 [3] and EVS [4] propose adaptive fade out techniques, which depend on the stability of the signal characteristics. A fade out factor depends on the parameters of the last good received superframe class and the number of consecutive erased superframes. The factor is further dependent on the stability of the LP filter for UNVOICED superframes (a classification between VOICED and UNVOICED frames being carried out). As there is no signal characteristics available in AAC decoders like AAC-ELD [5], the codec is damping the concealed signal blindly with a fix factor, which can leads to the annoying repetition artefacts discussed above.

In some conditions it has been found that annoying artefacts can be generated by holes in the spectral representation.

SUMMARY

An embodiment may have an error concealment unit for providing an error concealment audio information for concealing a loss of an audio frame in an encoded audio information, wherein the error concealment unit is configured to provide an error concealment audio information based on a properly decoded audio frame preceding a lost audio frame, wherein the error concealment unit is configured to perform a fade out using different damping factors for different frequency bands of the properly decoded audio frame preceding the lost audio frame, wherein the error concealment unit is configured to adapt one or more damping factors, so as to fade out one or more frequency bands of the properly decoded audio frame preceding the lost audio frame and having a comparatively higher energy per spectral bin faster than one or more frequency bands of the properly decoded audio frame preceding the lost audio frame and having a comparatively lower energy per spectral bin.

According to another embodiment, a method for providing an error concealment audio information for concealing a loss of an audio frame in an encoded audio information may have the steps of: providing an error concealment audio information based on a properly decoded audio frame preceding a lost audio frame; and performing a fade out using different damping factors for different frequency bands of the properly decoded audio frame preceding the lost audio frame, so as to fade out one or more frequency bands of the properly decoded audio frame preceding the lost audio frame and having a comparatively higher energy per spectral bin faster than one or more frequency bands of the properly decoded audio frame preceding the lost audio frame and having a comparatively lower energy per spectral bin.

Another embodiment may have a non-transitory digital storage medium having stored thereon a computer program for performing the above inventive method for providing an error concealment audio information when the computer program is run by a computer.

Still another embodiment may have an audio decoder for providing a decoded audio information on the basis of encoded audio information, the audio decoder having an inventive error concealment unit as mentioned above.

According to another embodiment, a method for providing an error concealment audio information for concealing a loss of an audio frame in an encoded audio information may have the steps of: performing a frequency domain concealment to provide an error concealment audio information component; fading out the concealed audio frames according to different damping factors for different frequency bands of the properly decoded audio frame preceding the lost audio frame, so as to fade out one or more frequency bands of the properly decoded audio frame preceding the lost audio frame and having a comparatively higher energy per spectral bin faster than one or more frequency bands of the properly decoded audio frame preceding the lost audio frame and having a comparatively lower energy per spectral bin.

Another embodiment may have an error concealment unit for providing an error concealment audio information for concealing a loss of an audio frame in an encoded audio information, wherein the error concealment unit is configured to provide an error concealment audio information based on a properly decoded audio frame preceding a lost audio frame, wherein the error concealment unit is configured to perform a fade out using different damping factors for different frequency bands of the properly decoded audio frame preceding the lost audio frame, wherein the error concealment unit is configured to set, for at least one frequency band, the damping factor on the basis of characteristics of a time domain representation of the properly decoded audio frame, wherein said characteristics include a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group.

According to another embodiment, a method for providing an error concealment audio information for concealing a loss of an audio frame in an encoded audio information may have the steps of: providing an error concealment audio information based on a properly decoded audio frame preceding a lost audio frame; and performing a fade out using different damping factors for different frequency bands of the properly decoded audio frame preceding the lost audio frame, further having the step of setting, for at least one frequency band, the damping factor on the basis of characteristics of a time domain representation of the properly decoded audio frame, wherein said characteristics include a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group.

According to another embodiment, a method for providing an error concealment audio information for concealing a loss of an audio frame in an encoded audio information may have the steps of: performing a frequency domain concealment to provide an error concealment audio information component; fading out the concealed audio frames according to different damping factors for different frequency bands of the properly decoded audio frame preceding the lost audio frame, further having the step of setting, for at least one frequency band, the damping factor on the basis of characteristics of a time domain representation of the properly decoded audio frame, wherein said characteristics include a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group.

Still another embodiment may have a non-transitory digital storage medium having stored thereon a computer program for performing the above inventive methods for providing an error concealment audio information when the computer program is run by a computer.

In accordance to embodiments of the invention, there is provided an error concealment unit for providing an error concealment audio information for concealing a loss of an audio frame in an encoded audio information. The error concealment unit is configured to provide an error concealment audio information using a frequency domain concealment based on a properly decoded audio frame preceding a lost audio frame. The error concealment unit is configured to fade out a concealed audio frame out according to different damping factors for different frequency bands.

In accordance to embodiments of the invention, there is also provided an error concealment unit for providing an error concealment audio information for concealing a loss of an audio frame in an encoded audio information. The error concealment unit is configured to provide an error concealment audio information for a lost audio frame on the basis of a properly decoded audio frame preceding the lost audio frame. The error concealment unit may be configured to derive one or more damping factors on the basis of characteristics of a decoded representation of the properly decoded audio frame preceding the lost audio frame. The error concealment unit is configured to perform a fade out using the damping factor(s).

It has been observed that, accordingly, issues caused by post echo artefacts can be overcome by using a technique based the analysis of the characteristics of a decoded representation of the properly decoded audio frame preceding the lost audio frame. The characteristics of the signal provide accurate information on the energy of the signal, which can be used to classify the audio information and to dampen the concealed audio frame according to such a classification.

In accordance to an aspect of the invention, the error concealment unit can be configured to derive the damping factor on the basis of characteristics of a decoded time domain representation of the properly decoded audio frame preceding the lost audio frame.

For example, it is possible to recognize that the previous properly decoded audio frame contains the end of a word or speech (or, in general, a decrease of energy of over time) simply on the basis of the aspects of such a time domain representation. Also, different features of the decoded audio frame (like a temporal modulation, a transient character, and others, can be derived with good accuracy from the decoded representation).

In accordance to an aspect of the invention, the error concealment unit can be configured to perform an analysis of the decoded time domain representation, and to derive the damping factor on the basis of the analysis.

Accordingly, it is possible to directly derive the damping factor by analysing the decoded time domain representation. Analyzing the decoded representation is typically much more accurate than estimating characteristics of the signal using input parameters of the decoding. In this case, the analysis is not done at the encoder.

Alternatively, some signal characteristics are calculated at the encoder and sent in the bitstream on which the decoder will then determine the damping factor.

In accordance to an aspect of the invention, the error concealment unit can be configured to derive the damping factor on the basis of a temporal energy trend of the decoded representation of the properly decoded audio frame preceding the lost audio frame.

In fact, it has been noted that it is possible to determine the nature of the properly decoded audio frame (which shall "substitute" the incorrectly received frame) by analysing its energy trend. As speech (and other intended audio information such as music) generally implies more energy than noise, the decaying of the energy in a frame can be used as an index of the occurrence of the end of a word. Hence, it is possible to fade out the audio information differently on the basis of the determined nature of the previously properly decoded audio frame. By applying different fadings to frames of different nature, it is possible to reduce the occurrence of post echo artefacts.

It has been recognized that the decoded representation (which may take the form of a time-domain representation) represents a temporal evolution of the audio signal more closely than an encoded representation, and that it is therefore advantageous to derive a damping factor (or even multiple damping factors) on the basis of characteristics of the decoded representation (wherein the characteristics of the decoded representation may, for example, be derived by an analysis of the decoded representation).

In accordance to an aspect of the invention, the error concealment unit can be configured to compute an energy of a first portion of the decoded representation of the properly decoded audio frame preceding the lost audio frame, or of a weighted version thereof, and to compute an energy of a second portion of the decoded representation of the properly decoded audio frame preceding the lost audio frame, or of a weighted version thereof. A start of the first portion of the decoded representation temporally precedes a start of the second portion of the decoded representation, or an average of time values of the first portion temporally precedes an average of time values of the second portion. The error concealment unit can be configured to compute the damping factor in dependency on the energy of the first portion and in dependency on the energy of the second portion.

Accordingly, it is possible to calculate an energy trend (e.g., embodied by an energy trend value): if a temporally previous portion of the frame has more energy than a subsequent portion of the frame, the end of a speech (or, in general, a decrease of the energy over time) can be determined with a sufficient degree of certainness. Notably, the first portion of the frame can contain the second portion (or vice versa). The average in time of the first portion precedes the average in time of the second portion (for example, the center of the first portion temporally precedes the center of the second portion).

In particular, the second portion of the decoded representation can contain a last interval of the samples of the decoded representation of the properly decoded audio frame preceding the lost audio frame. The first portion of the decoded representation can contain all the samples of the properly decoded audio frame preceding the lost audio frame, or an interval of the samples of the properly decoded audio frame preceding the lost audio frame which overlaps the second portion so that at least some of the samples of the first portion precede all the samples of the second portion.

Accordingly, one of the rationales underlying embodiments of the present invention is based on the observation that annoying repetition artefacts occur mainly when the lost frame follows the end of a speech: instead of reproducing silence or noise, a fragment of a word is uselessly repeated. This is one of the reasons why embodiments of the invention are based on recognizing that a lost frame (or the first of a sequence of consecutive lost frames) is the frame following the end of a word (or speech), e.g., by recognizing that the last properly decoded audio frame is the frame following the end of a word (or speech), or, more in general, a frame in which the energy level has dropped abruptly. (In some cases, where the frame a rather long, like 80 ms, even if the frame loss appears half way during the energy decay there can be some kind of post echo.)

It is possible to compute a quotient between:

- an energy in an end portion of the decoded representation of the properly decoded audio frame preceding the lost audio frame, or in an end portion of a scaled version of the decoded representation of the properly decoded audio frame preceding the lost audio frame, and
- a total energy in the decoded representation of the properly decoded audio frame preceding the lost audio frame, or in scaled version of the decoded representation of the properly decoded audio frame preceding the lost audio frame, to obtain the damping factor.

While the first portion can contain all the samples of the frame, the second portion could contain only the samples of the second half of the same frame (or some of the second half of the claims); by dividing a value related to the energy associated to the second portion with a value related to the energy associated to the first portion (the whole frame for example), a value can be obtained (when the first portion comprises the whole frame, the value can be between 0 and 1 and can be expressed as a percentage): the lower the value (or the percentage), the more probable the frame contains the end of a word (or a substantial decrease in energy over time).

In some embodiments, a quotient equal to zero could imply that energy is not present in the samples of the second portion, indicating that the samples of the second portion carry "silence" as unique information.

According to one embodiment, a temporal energy trend (fac) can be calculated using the formula:

$$fac = \sqrt{\frac{4\sum_{k=c\cdot L}^{L} w_{k-c\cdot L}\cdot x_k^2}{\sum_{k=1}^{L} x_k^2}}$$

wherein the value L is the frame length in samples, $x_k$ is (a value based on) the sampled signal value, $w_k$ is a weight factor, and c is a value between 0.5 and 0.9, advantageously between 0.6 and 0.8, more advantageously between 0.65 and 0.75, and even more advantageously 0.7. The value L can be the frame length in samples (e.g., a number such as 1024), $x_k$ can be the sampled signal value, $w_k$ can be a weight factor, and c can be a value between 0.5 and 0.9, advantageously between 0.6 and 0.8, more advantageously between 0.65 and 0.75, and even more advantageously 0.7.

Notably, $\Sigma_{k=c\cdot L}^{L} w_{k-c\cdot L}\cdot x_k^2$ keeps in account an integral energy of the last samples of the frame (in particular, weighted by a window), while $\Sigma_{k=1}^{L} x_k^2$ refers an integral energy associated to the whole frame.

A weight factor which verifies the following condition can also be calculated:

$$\frac{4\sum_{k=c\cdot L}^{L} w_{k-c\cdot L}}{L} = 1$$

It has been noted that an appropriate weight factor is:

$$w_k = \begin{cases} d\cdot\left(1-\cos\left(\frac{2\pi k}{h\cdot L-1}\right)\right), & 0 \le k < g\cdot L \\ 1, & k \ge g\cdot L \end{cases}$$

where d is a value between 0.4 and 0.6, advantageously between 0.49 and 0.51, more advantageously between 0.499 and 0.501, and even more advantageously 0.5; where h is a value between 0.15 and 0.25, advantageously between 0.19 and 0.21, more advantageously between 0.199 and 0.201, and even more advantageously 0.2; and where g is a value between 0.05 and 0.15, advantageously between 0.09 and 0.11, and more advantageously 0.1.

In accordance to an aspect of the invention, the error concealment unit can be configured to reduce the damping factor with respect to a previous concealed audio frame and to fade out at least one subsequent concealed audio frames, following the previously concealed audio frame using the reduced damping factor.

This solution is particularly advantageous when multiple consecutive frames are incorrectly decoded. In this way, the audio signal will be dampened properly.

In accordance to an aspect of the invention, the error concealment unit can be configured to perform the fade out according to a more than exponential time decay over at least three consecutive concealed audio frames.

It has been noted that a more than exponential time decay for damping factors associated to the fade out is of advantage and permits to obtain a good trade-off between gracefulness of the fading and reducing the intensity of the audio information. In particular, it has been noted that a particularly appropriate decay is obtained by iteratively multiplying the previous damping factor by 0.9 at the second consecutive lost frame, by 0.75 at the third consecutive lost frame, by 0.5 for the third consecutive lost frame, by 0.2 at the fourth and ff. consecutive lost frames.

In accordance to an aspect of the invention, the error concealment unit can be configured to determine an energy trend value quantitatively describing a temporal energy trend of the decoded representation of the properly decoded audio frame preceding the lost audio frame. The error concealment unit can be also configured to use the energy trend value, or a scaled version thereof, to define the damping factor.

In accordance to an aspect of the invention, the error concealment unit can be configured to set the damping factor to a predetermined value, lower than a current energy trend value, if the current energy trend value lies within a predetermined range indicating a comparatively small energy decrease over time.

Accordingly, if the temporal energy trend is close to 1 (or, at least, greater than a threshold that can be $(½)^{1/2}$), it can be determined with a sufficient degree of certainness that the properly decoded audio frame does not contain the end of speech (or anyway is not an audio frame in which energy decreases abruptly). Hence, it is possible to use a fixed damping value.

In accordance to an aspect of the invention, the error concealment can be configured to determine the damping factor such that the damping factor is equal to a current energy trend value, or varies linearly with varying energy trend value, if the current energy trend value lies outside the predetermined range and indicates a comparatively larger energy decrease over time.

Accordingly, if the temporal energy trend is less than the threshold (e.g., which can be $½^{1/2}$), it can be determined with a sufficient degree of certainness that the properly decoded audio frame contains the end of a word (or speech). Hence, it is possible to use a reduced damping value to speed up the fade out, thus avoiding the post echo according to the invention.

In accordance to an aspect of the invention, the error concealment can be configured to:

set the damping factor to a first predetermined value (which can be, for example, a value between 0.95 or 0.97 and 1), which indicates a smaller damping than a second predetermined value (which can be, for example, $$\sqrt{\frac{1}{2}} \pm 10\%\Big),$$

if it is recognized, advantageously on the basis of a bitstream information or on the basis of a signal analysis, that the properly decoded audio frame preceding the lost audio frame is noise-like, and/or to set the damping factor to the second predetermined value, if it is recognized, advantageously on the basis of a bitstream information or on the basis of a signal analysis, that the properly decoded audio frame preceding the lost audio frame is speech-like with the speech not ending in the properly decoded audio frame preceding the lost audio frame, and/or to set the damping factor to a value based on the energy trend value or a scaled version thereof, if it is recognized, advantageously on the basis of a bitstream information or on the basis of a signal analysis, that the properly decoded audio frame preceding the lost audio frame is speech-like with the speech decaying or ending in the properly decoded audio frame preceding the lost audio frame.

By classifying the properly decoded audio frame (e.g., as noise/speech-ending-in-the frame/speech-continuing), three different fadings can be performed:

small fading or no fading at all for noise (as of advantage for noise);

medium fading when the speech is not ending in the properly decoded audio frame (in the absence of the risk of annoying echo);

hard fading when the speech is terminated in the properly decoded audio frame (hence diminishing the effects of the annoying echo).

The error concealment is configured to determine different damping factors for different frequency bands.

In accordance to an aspect of the invention, the error concealment unit is configured to derive the damping factor such that the damping factor reflects an extrapolation of a temporal evolution of an energy level in an end portion of the last properly decoded audio frame preceding the lost audio frame towards the lost audio frame.

In accordance to an aspect of the invention, the error concealment unit is configured to scale a spectral representation of the audio frame preceding the lost audio frame using the damping factor, in order to derive a concealed spectral representation of the lost audio frame.

In accordance to an aspect of the invention, the error concealment unit is configured to scale a spectral representation of the audio frame preceding the lost audio frame using the damping factor, in order to derive a concealed spectral representation of the lost audio frame.

In accordance to an aspect of the invention, the error concealment unit is configured to perform a spectral-domain-to-time-domain transform, in order to obtain the decoded representation of the properly decoded audio frame preceding the lost audio frame.

In accordance to embodiments of the invention, there is provided an error concealment audio information method for concealing a loss of an audio frame in an encoded audio information, comprising the following steps:

deriving a damping factor on the basis of characteristics of a decoded representation of the properly decoded audio frame preceding the lost audio frame, and performing a fade out using the damping factor.

The method can be used in combination with any of the inventive aspects discussed above.

In accordance to embodiments of the invention, there is provided a computer program for performing the inventive method and/or for controlling the product embodiments of the invention discussed above when the computer program runs on a computer.

In accordance to embodiments of the invention, there is provided an audio decoder for providing decoded audio information on the basis of encoded audio information, the audio decoder comprising an error concealment unit as discussed above or implementing a method as discussed above.

In accordance to embodiments of the invention, there is provided an error concealment unit to provide error concealment audio information for concealing a loss of an audio frame in an encoded audio information, wherein the error concealment unit is configured to provide an error concealment audio information based on a properly decoded audio frame preceding a lost audio frame. The error concealment unit is configured to perform a fade out using different damping factors for different frequency bands.

It has been noted that it is possible to use different damping factors for different bands of the same spectral representation of the audio frame. Accordingly, it is possible to avoid the occurrence of annoying artefacts due to spectral holes, because it is possible, for example, to apply a different damping factor to a frequency band (or a spectral bin) which is noise-like than to a frequency band (or a spectral bin) which is speech-like (or which contains mostly speech).

Thus, damping factors can be adapted to signal characteristics of different frequency bands or of different spectral bins, or to a temporal evolution of the energy in different frequency bands or spectral bins.

In accordance to an aspect of the invention, the error concealment unit can be configured to derive the damping factors on the basis of characteristics of a spectral domain representation of the properly decoded audio frame preceding the lost audio frame.

In accordance to an aspect of the invention, the error concealment unit can be configured to adapt one or more damping factors, so as, for example, to fade out voiced frequency bands of the properly decoded audio frame preceding the lost audio frame faster than non-voiced or noise-like frequency bands of the properly decoded audio frame preceding the lost audio frame.

By adapting the fade out to each frequency band (or spectral bin), it is possible to obtain an optimum fading behaviour: in particular, spectral bands associated to speech can be dampened faster than spectral bands associated to noise, thus reducing annoyance for a person listening to the audio decoded information.

In accordance to an aspect of the invention, the error concealment unit can be configured to adapt one or more damping factors, so as to fade out one or more frequency bands of the properly decoded audio frame preceding the lost audio frame and having a comparatively higher energy per spectral bin faster than one or more frequency bands of the properly decoded audio frame preceding the lost audio frame and having a comparatively lower energy per spectral bin.

According to a rationale of the invention, bands with comparatively higher energy per spectral bin are expected to contain more speech information than noise. Therefore, it is proposed to increase the damping of these speech-related bands, while only slowly fading out low energy (noise-like) frequency bands.

In accordance to an aspect of the invention, the error concealment unit can be configured to set a damping factor, for at least one frequency band, on the basis of a comparison between an energy value associated to the at least one frequency band in the properly decoded audio frame preceding the lost audio frame and a threshold.

The comparison with a threshold permits to perform a simple (but important) test whose outcome is, inter alia, the determination of the band being expected to carry information relating to either speech or noise.

In accordance to an aspect of the invention, the error concealment unit can be configured to use a predetermined damping factor for at least one frequency band if the energy value associated to the at least one frequency band is lower than the threshold. The error concealment unit can be configured to use a damping factor which is smaller than a predetermined damping factor for the at least one frequency band if the energy value associated to the at least one frequency band is higher than the threshold.

Accordingly, higher-energy bands will be dampened faster than lower-energy bands, hence reducing annoyance for a listener.

In accordance to an aspect of the invention, the error concealment unit can be configured to use a damping factor representing a comparatively slower fade-out for the at least one frequency band if the energy value associated to the at least one frequency band is lower than the threshold. The error concealment unit can be configured to use a damping factor representing a comparatively faster fade-out for the at least one frequency band if the energy value associated to the at least one frequency band is higher than the threshold.

In accordance to an aspect of the invention, the error concealment unit can be configured to define the damping factor as a predetermined value if the energy value associated to the at least one frequency band is lower than the threshold. The error concealment unit can be configured, if the energy value associated to the at least one frequency band is higher than the threshold, to derive the damping factor for the at least one frequency band on the basis of a temporal energy trend value of the decoded representation of the properly decoded audio frame preceding the lost audio frame, so as to fade out the at least one frequency band faster than where the energy value associated to the at least one frequency band is lower than the threshold.

Not only is it possible to dampen the higher energy bands (expected to relate to speech) faster than the lower energy bands, but it is also possible to fade out the bands according to the evolution of the properly decoded audio frame. If, for example, the energy evolution of the properly decoded audio frame indicates that the latter is a frame in which a word (or speech) has ended, it is of advantage to increase the dampening of the higher energy bands, which are expected to relate to speech. Accordingly, annoying echo artefacts can be avoided when the properly decoded audio frame contains the end of a word.

In accordance to an aspect of the invention, the error concealment unit can be configured to define different thresholds for different frequency bands.

A band with many bins but low intensity, for example, can be expected to be associated to noise. To the contrary, a band with high energy can be expected to be associated to speech. Therefore, a distinction between these bands can be obtained by operating different comparisons with different thresholds for different bands.

In accordance to an aspect of the invention, the error concealment unit can be configured to set a threshold on the basis of an energy value, or an average energy value, or an expected energy value of the at least one frequency band.

A band with low energy, for example, can be expected to be associated to noise. To the contrary, a band with high energy can be expected to be associated to speech. Therefore, a distinction between these bands can be obtained by choosing, for each band, a threshold which depends on energy value, or an average energy value, or an expected energy value of the band.

In accordance to an aspect of the invention, the error concealment unit can be configured to set the threshold on the basis of a ratio between an energy value of the properly decoded audio frame preceding the lost audio frame and a number of spectral lines in the whole spectrum of the properly decoded audio frame preceding the lost audio frame.

In accordance to an aspect of the invention, the error concealment unit can be configured to set the threshold on the basis of a temporal energy trend of the decoded representation of the properly decoded audio frame preceding the lost audio frame.

The temporal energy trend can contain information of whether the properly decoded audio frame contains information if the end of a word is in the frame or not. It is of advantage to dampen faster frames following audio frames containing the end of a word, to avoid annoying echo artefacts. Hence, it can be of advantage to choose the threshold on the basis of the temporal energy trend. The higher the probability of the word terminating in the properly decoded frame (energy trend close to 0), the lower the threshold, the faster the damping of the band.

In accordance to an aspect of the invention, the error concealment unit can be configured to set the threshold for an i-th frequency band using the formula:

$$\text{threshold}_i = \text{newEnergyPerLine} \cdot nb\text{OfLines}_i$$

The value $\text{nbOfLines}_i$ can be the number of lines in the i-th frequency band, and $$newEnergyPerLine = \frac{fac}{nbOfTotalLines} \cdot energy_{total}$$

The value fac can be a quantity representing the temporal energy trend in the properly decoded audio frame preceding the lost audio frame, or a damping value derived from a quantity representing the temporal energy trend in the properly decoded audio frame preceding the lost audio frame. The value $energy_{total}$ can be a total energy over all frequency bands of the properly decoded audio frame preceding the lost audio frame. The value nbOfTotalLines can be a total number of spectral lines of the properly decoded audio frame preceding the lost audio frame.

In accordance to an aspect of the invention, the error concealment unit can be configured to perform a fade out using different damping factors for different scale factor bands. Different scale factors for scaling inversely quantized spectral values can be associated with different scale factor bands.

In accordance to an aspect of the invention, the error concealment unit can be configured to scale a spectral representation of the audio frame preceding the lost audio frame using the damping factors, in order to derive a concealed spectral representation of the lost audio frame.

In accordance to an aspect of the invention, the error concealment unit can be configured to scale different frequency bands of a spectral representation of the audio frame preceding the lost audio frame using different damping factors, to thereby fade out the spectral values of the different frequency bands with different fade-out-speeds, in order to derive a concealed spectral representation of the lost audio frame.

Accordingly, it is possible to obtain an appropriate concealment in which the bands containing information such as speech are damped more than those containing noise.

In accordance to an aspect of the invention, the error concealment unit can be configured to:

set the damping factor associated to a given frequency band to a first predetermined value (e.g., between 0.95 and 1), which indicates a smaller damping than a second predetermined value (e.g., around $\frac{1}{2}^{1/2}$), if it is recognized, advantageously on the basis of a bitstream information or on the basis of a signal analysis, that the properly decoded audio frame preceding the lost audio frame is noise-like, and/or set the damping factor associated to the given frequency band to the second predetermined value, if it is recognized, advantageously on the basis of a bitstream information or on the basis of a signal analysis, that the properly decoded audio frame preceding the lost audio frame is speech-like with the speech not ending in the properly decoded audio frame preceding the lost audio frame, and/or set the damping factor associated to the given frequency band to a value based on the energy trend value or a scaled version thereof, if it is recognized, advantageously on the basis of a bitstream information or on the basis of a signal analysis, that the properly decoded audio frame preceding the lost audio frame is speech-like with the speech decaying or ending in the properly decoded audio frame preceding the lost audio frame.

For example, it is possible to distinguish bands containing information such as speech (or intended audio information such as music) and those containing noise. The bands containing intended audio information can be dampened faster than those containing noise. In case the previously decoded audio frame contains the end of a word (or speech or anyway an intended audio information), the damping is comparatively increased (e.g. by reducing the damping factor).

In accordance to an aspect of the invention, the error concealment unit can be configured to compare an energy in a given frequency band with a threshold. The error concealment unit can be configured to provide a scaling factor for the given frequency band which is derived on the basis of a temporal energy trend of the decoded representation of the properly decoded audio frame preceding the lost audio frame if the energy in the given frequency band is larger than the threshold. The error concealment unit can be configured to set the damping factor to a first predetermined value, which indicates a smaller damping than a second predetermined value, if it is recognized, advantageously on the basis of a bitstream information or on the basis of a signal analysis, that the properly decoded audio frame preceding the lost audio frame is recognized as noise-like, and if the energy in the given frequency band is smaller than the threshold. The error concealment unit can be configured to set the damping factor to the second predetermined value, if the properly decoded audio frame preceding the lost audio frame is recognized, advantageously on the basis of a bitstream information or on the basis of a signal analysis, as being not noise-like.

In accordance to an aspect of the invention, the error concealment unit can be configured to perform a spectral-domain-to-time-domain transform, in order to obtain a decoded representation of a properly decoded audio frame preceding the lost audio frame.

Embodiments of the invention also relate to a method for providing an error concealment audio information for concealing a loss of an audio frame in an encoded audio information, the method comprising:

providing an error concealment audio information based on a properly decoded audio frame preceding a lost audio frame; and performing a fade out using different damping factors for different frequency bands The inventive method can implement one or more of the aspects discussed above.

Embodiments of the invention also relate to a computer program for performing the inventive methods when the computer program runs on a computer and/or for implementing the product aspects discussed above.

Embodiments of the invention also relate to an audio decoder comprising an error concealment unit as discussed above.

The audio decoder can be configured to scale spectral values of different scale factor bands of a spectral representation of the audio frame preceding the lost audio frame using different scale factors The aspects discussed above can be combined with each other.

BRIEF DESCRIPTION OF THE DRAWINGS

Embodiments of the present invention will subsequently be described taking reference to the enclosed figures, in which.

DETAILED DESCRIPTION OF THE INVENTION

In the present section, embodiments of the invention are discussed with reference to the drawings.

Figure 1:
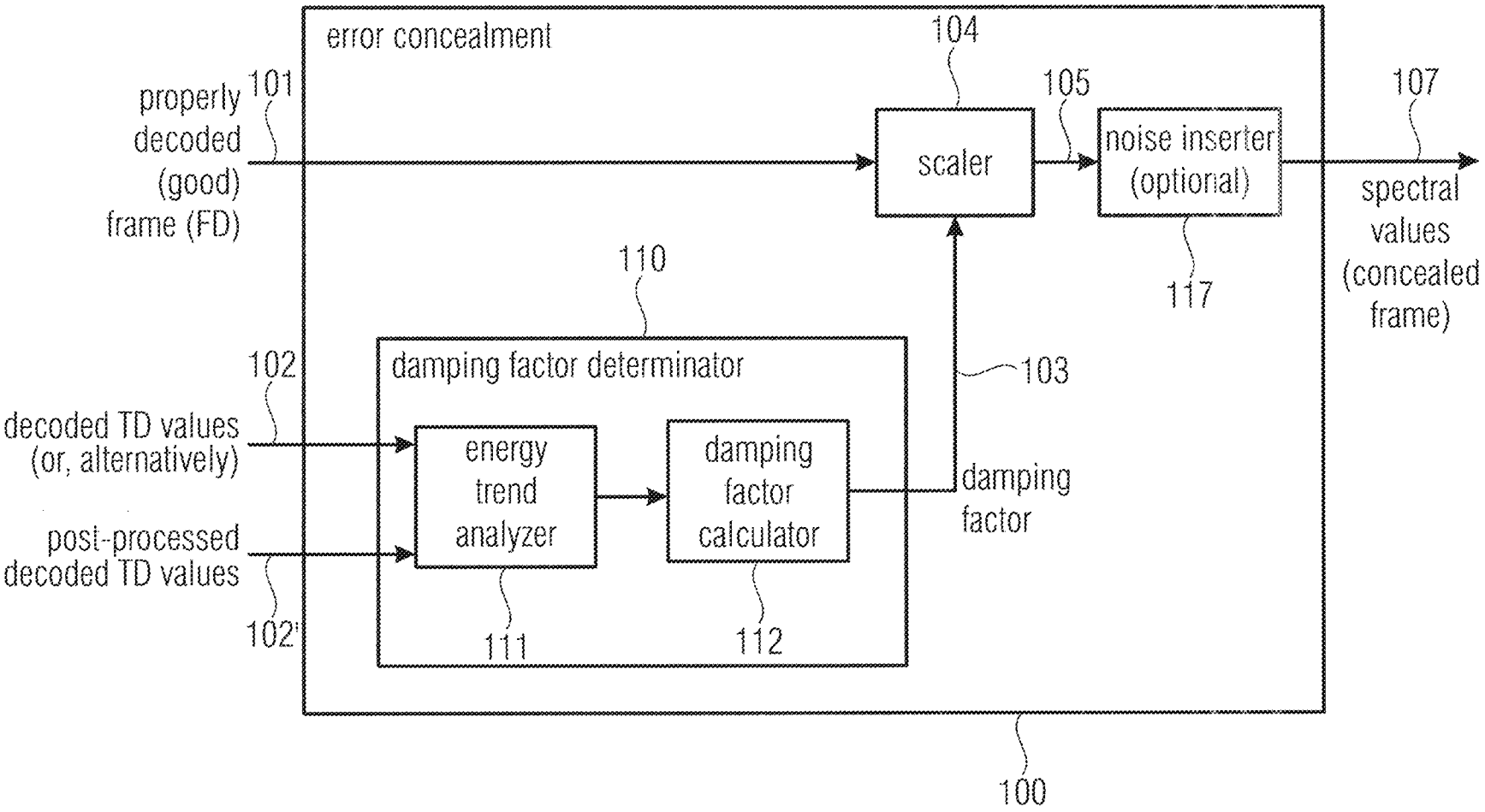
FIG. 1 shows a block schematic diagram of a concealment unit according to the invention.

Error Concealment Unit According to FIG. 1

FIG. 1 shows a block schematic diagram of an error concealment unit 100 according to the invention.

The error concealment unit 100 provides an error concealment audio information 107 for concealing a loss of an audio frame in an encoded audio information. The error concealment unit 100 is input by audio information, such as a spectral version (or representation) 101 of a properly decoded audio frame. Further, the error concealment unit 100 is input by audio information, such as the time domain version 102 (or representation) of a properly decoded audio frame (in particular, the same properly decoded audio frame whose spectral value is input as 101). A post-processed version 102' can be used instead of the time domain signal 102 (hereinafter, reference is made only to the time domain signal 102 for brevity, despite it is possible to embody the invention using the post-processed version 102').

The error concealment unit 100 is configured to derive a damping factor 103 on the basis of characteristics of the decoded representation 102 of the properly decoded audio frame preceding the lost audio frame.

The error concealment unit 100 is configured to perform a fade out using the damping factor 103.

An example of fade out can be implemented by a scaler 104, to scale the spectral version 101 of the properly decoded audio frame using the damping factor 103.

A damping factor determinator 110 can be implemented to derive the damping factor 103 on the basis of the time domain version 102 of the properly decoded audio frame.

The damping factor determinator 110 can derive the damping factor 103 on the basis of characteristics of the decoded time domain representation 102 of the properly decoded audio frame preceding the lost audio frame.

An energy trend analyzer 111 can be used to perform an analysis of the properly decoded audio frame 102. According to some implementations, the trend of the energy in the frame can be analysed.

A damping factor mapper (or calculator) 112 can be used to scale the damping factor (e.g., when multiple consecutive incorrect data frames are obtained).

Moreover, by means of noise adder 117, noise can optionally be added to the scaled version 105 of the frequency-domain representation 101, to derive the frequency-domain representation 107 of the concealed frame.

It is noted that, according to an embodiment of the error concealment unit 100, the spectral representation 101 of the properly decoded frame may optionally be divided into different bands; the scaler 104 may, in this case, adopt a plurality of scale factors, one for each of the bands.

Figure 2:
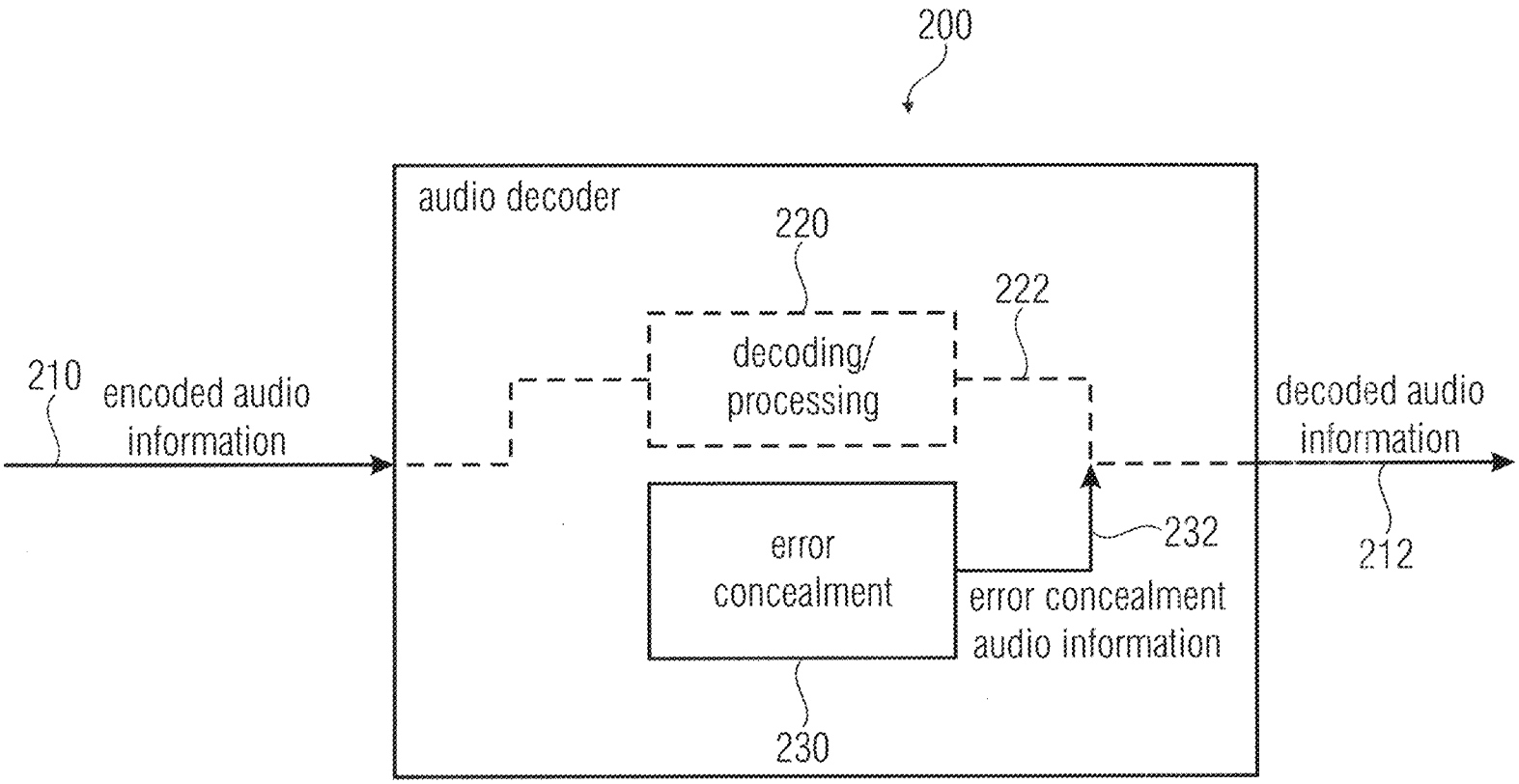
FIG. 2 shows a block schematic diagram of an audio decoder according to an embodiment of the present invention.

Error Concealment Unit According to FIG. 2

FIG. 2 shows a block schematic diagram of an audio decoder 200, according to an embodiment of the present invention. The audio decoder 200 receives an encoded audio information 210, which may, for example, comprise an audio frame encoded in a frequency-domain representation. The encoded audio information 210 is, in principle, received via an unreliable channel, such that a frame loss occurs from time to time. The audio decoder 200 further provides, on the basis of the encoded audio information 210, the decoded audio information 212.

The audio decoder 200 may comprise a decoding/processing 220, which provides the decoded audio information on the basis of the encoded audio information in the absence of a frame loss.

The audio decoder 200 further comprises an error concealment 230 (which can be embodied by the error concealment unit 100), providing an error concealment audio information 232. The error concealment 230 is configured to provide the error concealment audio information 232 (105, 107) for concealing a loss of an audio frame.

In other words, the decoding/processing 220 may provide a decoded audio information 222 for audio frames which are encoded in the form of a frequency domain representation, i.e. in the form of an encoded representation, encoded values of which describe intensities in different frequency bins. Worded differently, the decoding/processing 220 may, for example, comprise a frequency domain audio decoder, which derives a set of spectral values from the encoded audio information 210 and performs a frequency-domain-to-time-domain transform to thereby derive a time domain representation which constitutes the decoded audio information 222 or which forms the basis for the provision of the decoded audio information 122 in case there is additional post processing.

Moreover, it should be noted that the audio decoder 200 can be supplemented by any of the features and functionalities described in the following, either individually or taken in combination.

The error concealment 230 can also fade out different bands with different damping factors in some embodiments.

Figure 3:
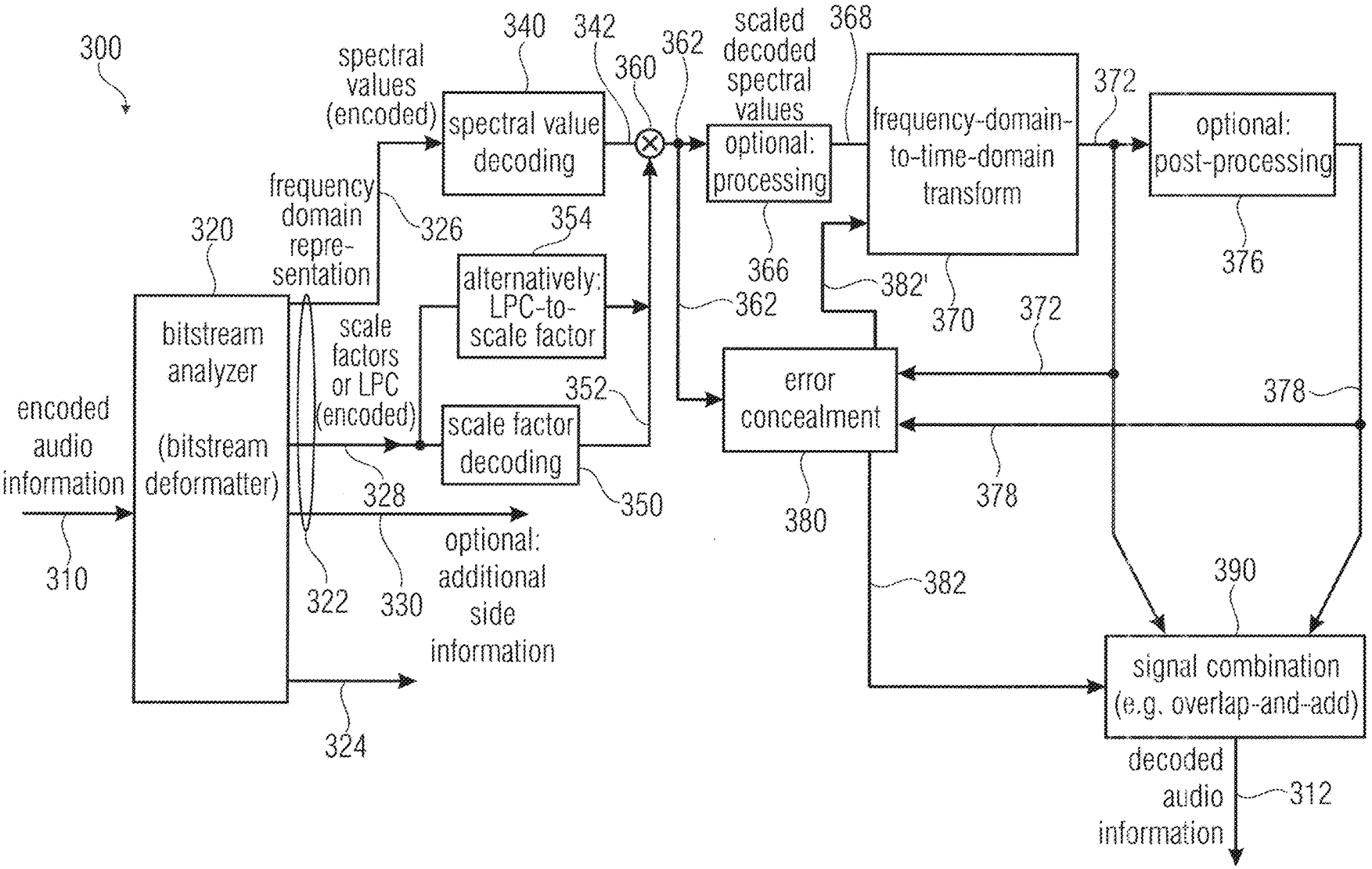
FIG. 3 shows a block schematic diagram of an audio decoder according to another embodiment of the present invention.

Audio Decoder According to FIG. 3

FIG. 3 shows a block schematic diagram of an audio decoder 300, according to an embodiment of the invention.

The audio decoder 300 is configured to receive an encoded audio information 310 and to provide, on the basis thereof, a decoded audio information 312. The audio decoder 300 comprises a bitstream analyzer 320 (which may also be designated as a "bitstream deformatter" or "bitstream parser"). The bitstream analyzer 320 receives the encoded audio information 310 and provides, on the basis thereof, a frequency domain representation 322 and possibly additional control information 324. The frequency domain representation 322 may, for example, comprise encoded spectral values 326, encoded scale factors 328 and, optionally, an additional side information 330 which may, for example, control specific processing steps, like, for example, a noise filling, an intermediate processing or a post-processing. The audio decoder 300 also comprises a spectral value decoding 340 which is configured to receive the encoded spectral values 326, and to provide, on the basis thereof, a set of decoded spectral values 342. The audio decoder 300 may also comprise a scale factor decoding 350, which may be configured to receive the encoded scale factors 328 and to provide, on the basis thereof, a set of decoded scale factors 352.

Alternatively to the scale factor decoding, an LPC-to-scale factor conversion 354 may be used, for example, in the case that the encoded audio information comprises an encoded LPC information, rather than a scale factor information. However, in some coding modes (for example, in the TCX decoding mode of the USAC audio decoder or in the EVS audio decoder) a set of LPC coefficients may be used to derive a set of scale factors at the side of the audio decoder. This functionality may be reached by the LPC-to-scale factor conversion 354.

The audio decoder 300 may also comprise a scaler 360, which may be configured to apply the set of scaled factors 352 to the set of spectral values 342, to thereby obtain a set of scaled decoded spectral values 362. For example, a first frequency band comprising multiple decoded spectral values 342 may be scaled using a first scale factor, and a second frequency band comprising multiple decoded spectral values 342 may be scaled using a second scale factor. Accordingly, the set of scaled decoded spectral values 362 is obtained. The audio decoder 300 may further comprise an optional processing 366, which may apply some processing to the scaled decoded spectral values 362. For example, the optional processing 366 may comprise a noise filling or some other operations.

The audio decoder 300 may also comprise a frequency-domain-to-time-domain transform 370, which is configured to receive the scaled decoded spectral values 362, or a processed version 378 thereof, and to provide a time domain representation 372 associated with a set of scaled decoded spectral values 362. For example, the frequency-domain-to-time domain transform 370 may provide a time domain representation 372, which is associated with a frame or sub-frame of the audio content. For example, the frequency-domain-to-time-domain transform may receive a set of MDCT coefficients (which can be considered as scaled decoded spectral values) and provide, on the basis thereof, a block of time domain samples, which may form the time domain representation 372.

The audio decoder 300 may optionally comprise a post-processing 376, which may receive the time domain representation 372 and somewhat modify the time domain representation 372, to thereby obtain a post-processed version 378 of the time domain representation 372.

According to the invention, the audio decoder 300 comprises an error concealment 380 (which can be embodied by one of the concealment units 100 or 230). The error concealment 380 receives the decoded spectral values 362 (which can embody the values 101) or their ports-processed version 368.

The error concealment 380 may also receive the time domain representation 372 (which can embody the value 102) from the frequency-domain-to-time-domain transform or the post-processed values 378 (which can embody the value 102') from the optional post-processing 376. However, in an embodiment in which the error concealment applies different damping factors to different frequency bands, but does not derive one or more damping factors on the basis of a decoded representation of a properly decoded audio frame, it may not be necessary that the error concealment 380 receives the signals 372, 378.

Further, the error concealment 380 provides an error concealment audio information 382 for one or more lost audio frames. If an audio frame is lost, such that, for example, no encoded spectral values 326 are available for said audio frame (or audio sub-frame), the error concealment 380 may provide the error concealment audio information. The error concealment audio information may be a frequency domain representation of an audio content (which may be provided to the frequency-domain-to-time-domain transformer 370) or a time domain representation of the audio content (which may be provided to a signal combination 390).

It should be noted that the error concealment 380 may, for example, perform the functionality of the error concealment unit 100 and/or the error concealment 230 described above. The error concealment 380 may output a time domain concealment signal 382 to the signal combination 390, or a frequency domain concealment signal 382' to the frequency-domain-to-time-domain transform 370.

Regarding the error concealment, it should be noted that the error concealment does not happen at the same time of the frame decoding. For example if the frame n is good then we do a normal decoding, and at the end we save some variable that will help if we have to conceal the next frame, then if frame n+1 is lost we call the concealment function giving the variable coming from the previous good frame. We will also update some variables to help for the next frame loss or on the recovery to the next good frame.

The audio decoder 300 also comprises a signal combination 390, which is configured to receive the time domain representation 372 (or the post-processed time domain representation 378 in case that there is a post-processing 376). Moreover, the signal combination 390 may receive the error concealment audio information 382, which is typically also a time domain representation of an error concealment audio signal provided for a lost audio frame. The signal combination 390 may, for example, combine time domain representations associated with subsequent audio frames. In the case that there are subsequent properly decoded audio frames, the signal combination 390 may combine (for example, overlap-and-add) time domain representations associated with these subsequent properly decoded audio frames. However, if an audio frame is lost, the signal combination 390 may combine (for example, overlap-and-add) the time domain representation associated with the properly decoded audio frame preceding the lost audio frame and the error concealment audio information associated with the lost audio frame, to thereby have a smooth transition between the properly received audio frame and the lost audio frame. Similarly, the signal combination 390 may be configured to combine (for example, overlap-and-add) the error concealment audio information associated with the lost audio frame and the time domain representation associated with another properly decoded audio frame following the lost audio frame (or another error concealment audio information associated with another lost audio frame in case that multiple consecutive audio frames are lost).

Accordingly, the signal combination 390 may provide a decoded audio information 312, such that the time domain representation 372, or a post processed version 378 thereof, is provided for properly decoded audio frames, and such that the error concealment audio information 382 is provided for lost audio frames, wherein an overlap-and-add operation is typically performed between the audio information (irrespective of whether it is provided by the frequency-domain-to-time-domain transform 370 or by the error concealment 380) of subsequent audio frames. Since some codecs have some aliasing on the overlap and add part that need to be canceled, optionally we can create some artificial aliasing on the half a frame that we have created to perform the overlap add.

It should be noted that the functionality of the audio decoder 300 is similar to the functionality of the audio decoder 200 according to FIG. 2. Moreover, it should be noted that the audio decoder 300 according to FIG. 3 can be supplemented by any of the features and functionalities described herein. In particular, the error concealment 380 can be supplemented by any of the features and functionalities described herein with respect to the error concealment.

In one embodiment, the error concealment 380 can perform a concealment on scale factor bands, for example, as described below taking reference to FIG. 14. In this case, the damping factors may or may not be provided on the basis of characteristics of the decoded representation of the properly decoded audio frame.

Frequency Domain Error Concealment and Fade Out

Some information is here provided relating to a frequency domain concealment as can be embodied or used by the error concealment unit 100. For example, the functionality described below can be obtained, in part or in full, in the scaler 104.

A frequency domain concealment function increases the delay of a decoder by one frame.

Frequency domain concealment works on the spectral data for example just before the final frequency to time conversion. In case a single frame is corrupted, concealment may interpolate between the last (or one of the last) good frame (properly decoded audio frame) and the first good frame to create the spectral data for the missing frame. The previous frame can be processed by the frequency to time conversion (e.g., the frequency-domain-to-time-domain transform 370). If multiple frames are corrupted, concealment implements first a fade out based on slightly modified spectral values from the last good frame. As soon as good frames are available, concealment fades in the new spectral data.

Figure 4:
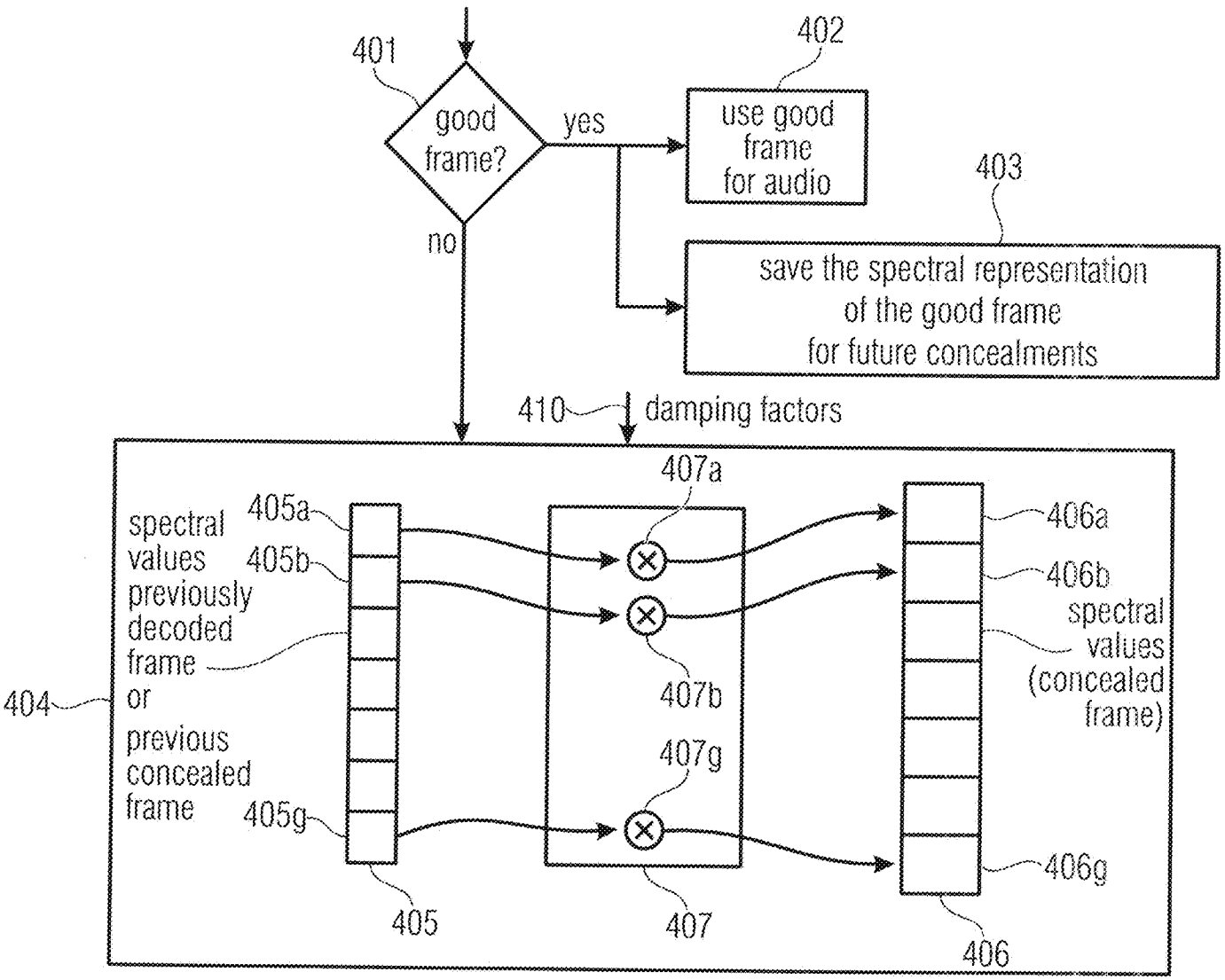
FIG. 4 shows a block schematic diagram of a frequency domain concealment according to an embodiment of the invention.

A frequency domain concealment is depicted in FIG. 4. At step 401 it is determined (e.g., based on CRC or a similar strategy) if the current audio information contains a properly decoded frame. If the outcome of the determination is positive, a spectral value of the properly decoded frame is used as proper audio information at 402. The spectrum is also recorded in a buffer 403 for further use.

If the outcome of the determination is negative (corrupted frame), at step 404 a previously recorded spectral representation 405 of the previous properly decoded audio frame (saved in a buffer at step 403 in a previous cycle) is used to "substitute" the corrupted (and discarded) audio frame.

In particular, a copier and scaler 407 copies and scales spectral values of the frequency bins (or spectral bins) 405*a*, 405*b*, . . . , in the frequency range of the previously recorded properly decoded spectral representation 405 of the previous properly decoded audio frame, to obtain values of the frequency bins (or spectral bins) 406*a*, 406*b*, . . . , to be used instead of the corrupted audio frame.

Each of the spectral values can be multiplied by a common scaling value, or by a respective coefficient (or damping factor) according to the specific information carried by the band. Also, noise can optionally be added in the spectral values 406.

Further, one or more damping factors 410 can be used to dampen the signal to iteratively reduce the strength of the signal in case of consecutive concealments.

In particular, different damping factors 410 can optionally be used in some embodiments to differently dampen different bands (e.g. scale factor bands).

To conclude, the copier and scaler 407 may embody the scaler 104, and the step 404 may optionally also comprise the functionality of the noise inserter 107.

Analysis of the Temporal Energy Trend of the Properly Decoded Audio Frame

According to embodiments of the invention, it is possible to derive the damping factors (e.g. in 110, 230, 380, or 404) on the basis of characteristics of a decoded time domain representation (e.g., 102, 102', 372, 378) of the properly decoded audio frame preceding the lost audio frame.

Figure 5:
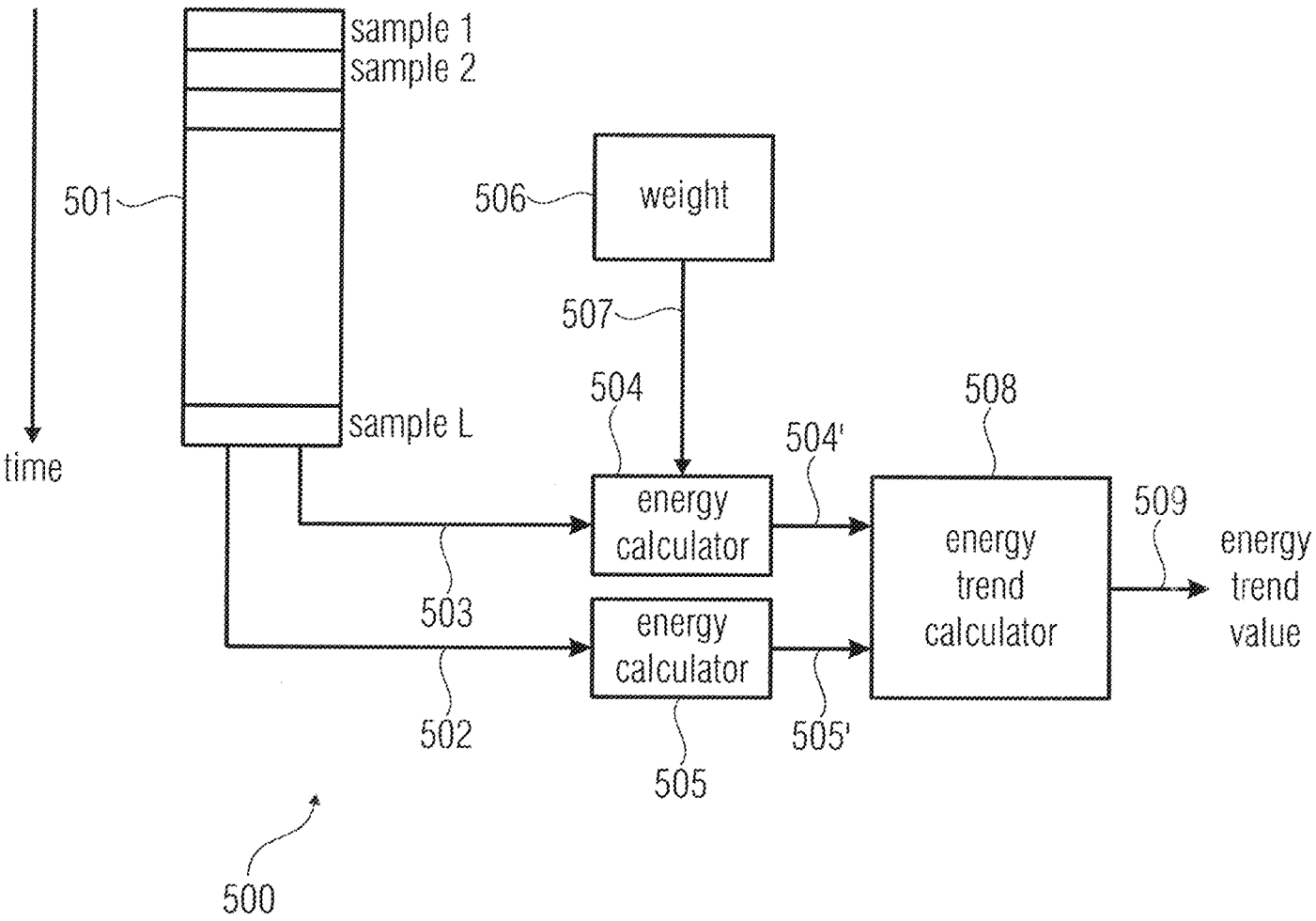
FIG. 5 shows particulars of a calculation of an energy trend value according to an embodiment of the invention.

FIG. 5 shows an example of energy trend analyzer 500 which can embody the analyzer 111. The energy trend analyzer 500 comprises a memory portion (e.g., buffer) 501 in which samples of the time domain representation of a properly decoded audio frame are stored. The number of samples can be 1024 according to some embodiments. Each field of the buffer stores the value of one sample.

A first portion 502 can be formed by a certain number of samples or also all the samples. A second portion 503 can be formed by a certain number of samples, for example the last 30% of the samples (e.g., about 307 samples out of 1024), or a subset of the samples of the second half of the frame. The average in time of the first portion 502 precedes the average in time of the second portion 503. An important number of the samples of the first portion 502 may precede most of the samples of the second portion 503.

At 504, a value 504' related to the energy of the second portion 503 (or representing the energy of the second portion 503) can be calculated. Weight values 507 obtained by a weight block 506 can also be applied to the second portion 503. For example, the energy trend calculator may comprise (for example by computing a difference or a quotient) the values 504', 505', to derive an energy trend value.

At 505, a value 505' related to the energy of the first portion 505 can be calculated.

An energy trend calculator 508 can be used to obtain an energy trend value 509 and can be used, for example, to calculate the damping factor.

According to some embodiments, even if the concealment is performed so as to use different damping factors for different spectral bands of the frequency domain representation of the properly decoded audio frame, the energy trend value does not vary for different bands of the same frame. Rather, a single energy trend value may be computed for a given frame.

The First and the Second Portion of the Frame

In order to obtain (or choose) the first and the second portion of the frame (for example, for the calculation of the energy trend value), several strategies can be used.

Figures 6A, 6B, 6C, 6D:
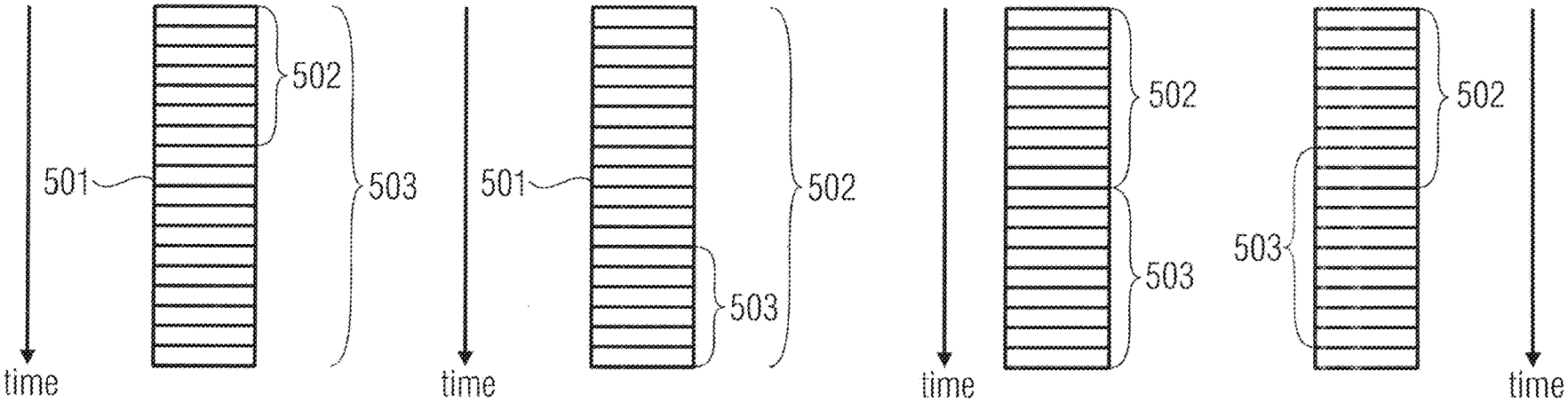
FIGS. 6(*a*)-6(*d*) show particulars of a subdivision of a frame used for calculating the energy trend according to an embodiment of the an embodiment of invention.

FIG. 6(*a*) shows that the first portion 502 is formed by an initial interval of samples, while the second portion 503 contains all the samples of the frame. In alternative embodiments, the first portion is formed by a group of samples which are only taken in an initial interval of the frame, while the second portion is formed by a group of samples taken throughout the whole frame (not only in the initial interval).

FIG. 6(*b*) shows that the first portion 502 contains all (or almost all) the samples of the frame, while the second portion 503 is formed by a final interval (or group) of samples. For example, the first portion 502 can contain 1024 samples and the second portion 503 only the last 30% of the samples.

FIG. 6(*c*) shows that the first portion 502 contains initial samples of the frame, while the second portion 503 contains a final interval (or group) of samples.

FIG. 6(*d*) shows an embodiment in which the first and the second portions are two different intervals (or groups of samples only taken from two different intervals) such that most (or a significant group) of the samples of the first portion precedes most (or a significant group) of the samples of the second portion.

If each of the samples is associated to a time $t_0$, $t_1$, $t_2$ . . . $t_L$ ($t_0$ and $t_L$ respectively being the first and last sample instants of the frame, e.g., the first and $1024^{th}$ samples of the frame), and a portion of the frame is generally formed by an interval of time instants that start at instant $k_{initial}$ and ends at instant $k_{final}$, the average in time of the first interval is provided by $$\text{average} = \frac{\sum_{k=k_{initial}}^{k_{final}} t_k}{k_{final} - k_{initial}}$$

For example, the average in time of the second portion 503 in FIG. 6(*a*) and the average in time of the first portion 502 in FIG. 6(*b*) is exactly in the middle of the frame.

The embodiment of FIG. 6(*b*) is considered the embodiment, and reference will be made to it in the following paragraphs.

The Temporal Energy Trend

A temporal energy trend value (e.g., 509) can be calculated (e.g. in the trend calculator 508) using the formula:

$$fac = \sqrt{\frac{4\sum_{k=c\cdot L}^{L} w_{k-c\cdot L}\cdot x_k^2}{\sum_{k=1}^{L} x_k^2}}$$

wherein the L is the frame length (e.g., of the properly decoded audio frame) in samples, $x_k$ is the sampled signal value (e.g., a value of the decoded representation of the properly decoded audio frame preceding the lost audio frame), $w_k$ is a weight factor, and c is a value between 0.5 and 0.9, advantageously between 0.6 and 0.8, more advantageously between 0.65 and 0.75, and even more advantageously 0.7.

$\Sigma_{k=c\cdot L}^{L} w_{k-c\cdot L}\cdot x_k^2$ keeps in account an integral energy of the second portion (e.g., the final interval) of the properly decoded audio frame preceding the lost audio frame; $\Sigma_{k=1}^{L} x_k^2$ keeps in account an integral energy associated to the first portion of the of the properly decoded audio frame (in this case, the whole frame as indicated in FIG. 6(*b*)).

By defining the first portion and the second portion of the audio frame as in FIG. 6(*b*), the temporal energy trend value fac is a value between 0 and 1. In that case, the temporal energy trend fac can be intended as a percentage: if all the energy is distributed in the last interval of the frame, the percentage of the energy trend will be 100%. If all the energy is distributed at the beginning of the frame, the energy trend will be 0%.

A weight factor which verifies the following condition can also be calculated to verify the following equation:

$$\frac{4\sum_{k=c\cdot L}^{L} w_{k-c\cdot L}}{L} = 1$$

It has been noted that an appropriate weight factor is:

$$w_k = \begin{cases} d\cdot\left(1-\cos\left(\frac{2\pi k}{h\cdot L-1}\right)\right), & 0 \le k < g\cdot L \\ 1, & k \ge g\cdot L \end{cases}$$

where d is a value between 0.4 and 0.6, advantageously between 0.49 and 0.51, more advantageously between 0.499 and 0.501, and even more advantageously 0.5; where h is a value between 0.15 and 0.25, advantageously between 0.19 and 0.21, more advantageously between 0.199 and 0.201, and even more advantageously 0.2; and where g is a value between 0.05 and 0.15, advantageously between 0.09 and 0.11, and more advantageously 0.1.

In other words, the window values $w_k$ can be normalized.

Figure 7:
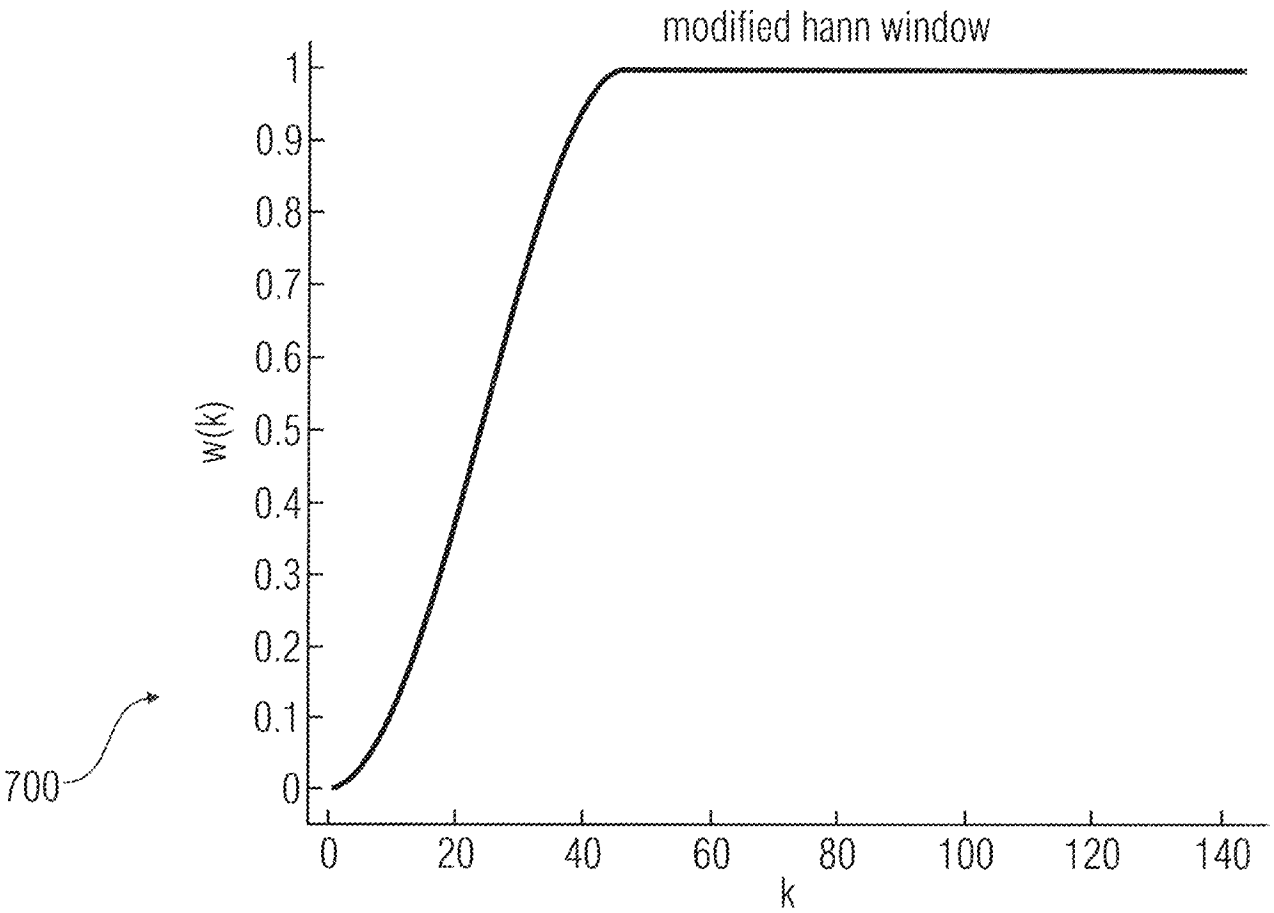
FIG. 7 shows a diagrams of a weight ("modified hann window") used to calculate the energy trend value according to an embodiment of the invention.

FIG. 7 shows a graphical representation 700 of the weight factor.

The energy trend value quantitatively describes a temporal energy trend of the decoded representation of the properly decoded audio frame preceding the lost audio frame. Its value, or a scaled (or limited) version thereof, can be used to define a damping factor (e.g., 103 or 410).

Calculation of the Damping Factor

Figure 8A:
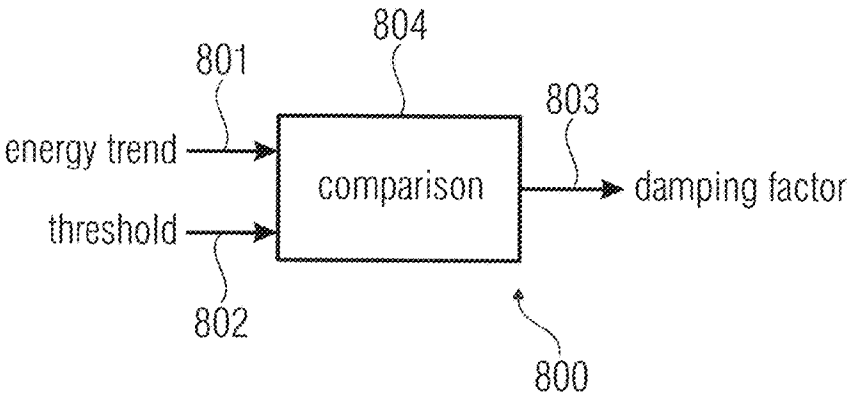
FIGS. 8(*a*)-8(*c*) show embodiments of means used to calculate the damping factor according to an embodiment of the invention.
Figure 8B:
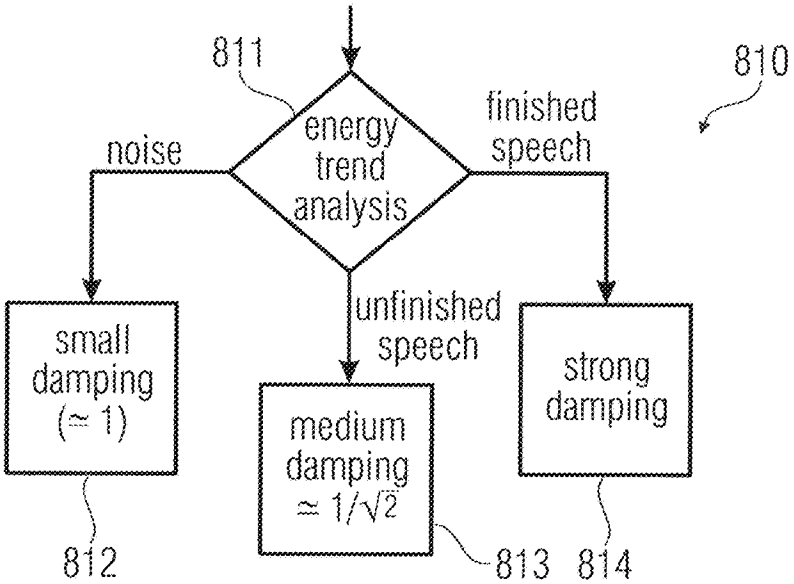
Figure 8C:
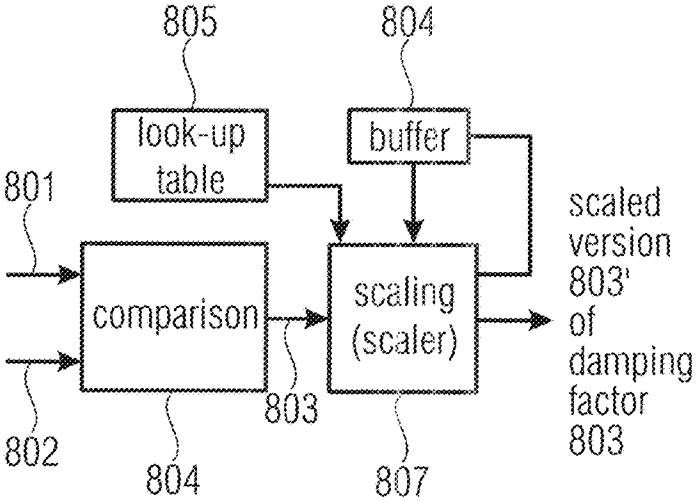

FIG. 8(*a*) shows an example of damping factor calculator 800 which can embody the calculator 112. At block 804, the energy trend value 801 (e.g., 509) is compared with a threshold 802. A damping factor 803 (which can embody the values 103 or 410) is obtained.

The damping factor 803 can be set (e.g., by block 804) to a predetermined value, lower than a current energy trend value (e.g., indicating a larger damping or an energy decrease over time of when compared to the energy trend value), if the current energy trend value lies within a predetermined range indicating a comparatively small energy decrease over time.

The damping factor 803 can also be set to be equal to a current energy trend value 801, or can or vary linearly with varying energy trend value 801, if the current energy trend value 801 lies outside the predetermined range and indicates a comparatively larger energy decrease over time.

Notably, when different damping factors are defined for different bands, a different damping factor 803 can be obtained for each band of the properly decoded audio frame. For example, a different threshold 802 can be defined for each frequency band.

FIG. 8(*b*) shows, as an additional example, a determination 810 of a damping factor carried out using the energy trend value (e.g., 509 or 801). At 811, an analysis of the energy trend value is performed. The analysis can contemplate the calculation the temporal energy trend value according to one of the examples discussed above.

If it is recognized that the properly decoded audio frame mostly contains noise, a small damping (or no damping at all) is performed at 812, for example by defining a damping factor at 0.98 or 1.

If it is recognized that the properly decoded audio frame mostly contains speech but a word is not terminated in the properly decoded audio frame (or that the energy trend value indicates a comparatively smaller energy decrease over time), a reduced (medium) damping is carried out at 813, for example by defining a damping factor 0.7071.

If it is recognized that the properly decoded audio frame contains speech terminating in the same frame (or that the energy trend value indicates a significant energy decrease in the properly decoded audio frame), a fast damping is carried out at 814. Where the temporal energy trend value is calculated as above (and the first and second portion of the frame are defined similarly to the embodiment of FIG. 6(*b*)), it is also possible to define the damping factor 803 as being the same value (or a scaled value) of the energy trend value 801 (or 509).

Basically, it is possible to carry out embodiments in which the damping factor reflects an extrapolation of a temporal evolution of an energy level in an end portion of the last properly decoded audio frame preceding the lost audio frame towards the lost audio frame.

Notably, when different damping factors are defined for different bands, steps 811-814 can be performed for each band of the properly decoded audio frame.

Decay of the Damping Factor

It is possible to configure the error concealment unit so that, in case multiple consecutive frames are lost, the damping factor decays, e.g., following a more than exponential decay.

FIG. 8(*c*) shows a variant of FIG. 8(*a*) in which a scaler 807 provides a scaled version 803' of the damping factor 803. While the comparison block 804 operates by comparing the energy trend value 801 with the threshold 802, the damping factor 803 is memorized in a buffer 804. When two consecutive frames are lost, the damping factor memorized in the buffer 804 (which is used for the first lost frame or for the previous frame) is multiplied by a factor contained in a look-up table 805, in order to obtain the damping factor for the second lost frame or, generally, for the subsequent frames or the current one.

For consecutive frame losses, the damping factor of the current frame fac can be dependent on the previous one $fac_{-1}$:

$$fac = fac_{-1} \cdot \begin{cases} 0.9, & \text{for } nbLost == 2 \\ 0.75, & \text{for } nbLost == 3 \\ 0.5, & \text{for } nbLost == 4 \\ 0.2, & \text{for } nbLost > 4 \end{cases}$$

where nbLost is the number of consecutive lost frames. This leads to less post echoes due to a faster fade out.

Notably, when different damping factors are defined for different bands, different decays can apply to different frequency bands.

Inventive Methods

Figure 9A:
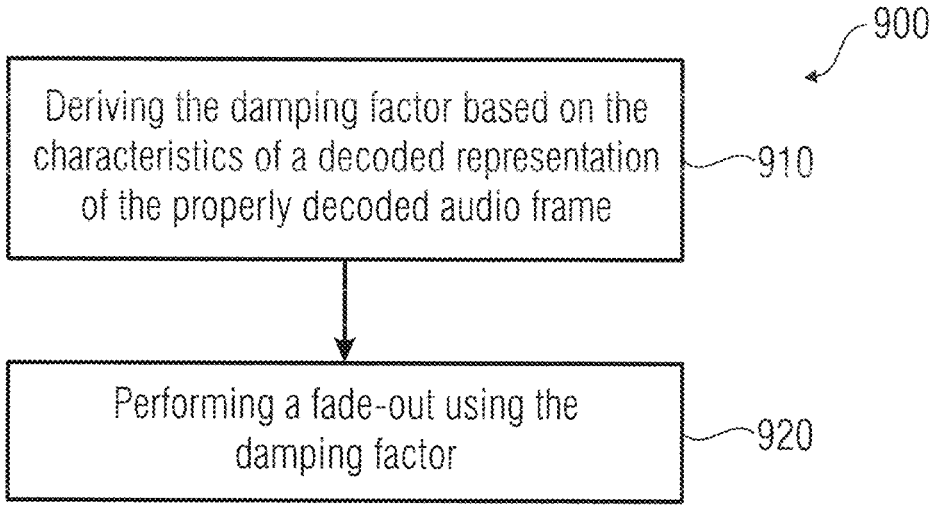
FIGS. 9(*a*)-9(*b*) show embodiments of inventive concealing methods.
Figure 9B:
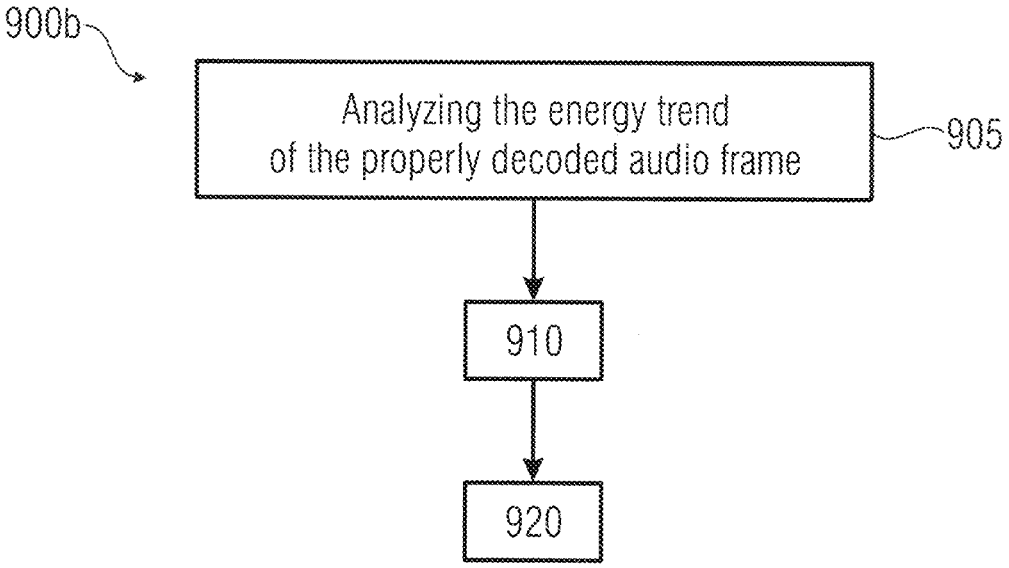

FIG. 9(*a*) shows an error concealment method 900 for providing an error concealment audio information for concealing a loss of an audio frame in an encoded audio information, comprising the following steps:

at 910, deriving a damping factor (e.g., the damping factor 103, 803, or 803') on the basis of characteristics of a decoded representation (e.g., 102) of the properly decoded audio frame (e.g., contained in 501) preceding the lost audio frame, and at 920, performing a fade out (e.g., at 811-814) using the damping factor.

FIG. 9(*b*) shows a variant 900*b* in which, before step 910, a step 905 is performed in which the energy trend value of the properly decoded audio frame is analyzed.

Notably, when different damping factors are defined for different bands, the methods are repeated (e.g., by iteration) for different bands of the properly decoded audio frame.

Operation of an Embodiment of the Invention and Experimental Results

It is intended to fade out a concealed frame according to the invention.

Figure 10:
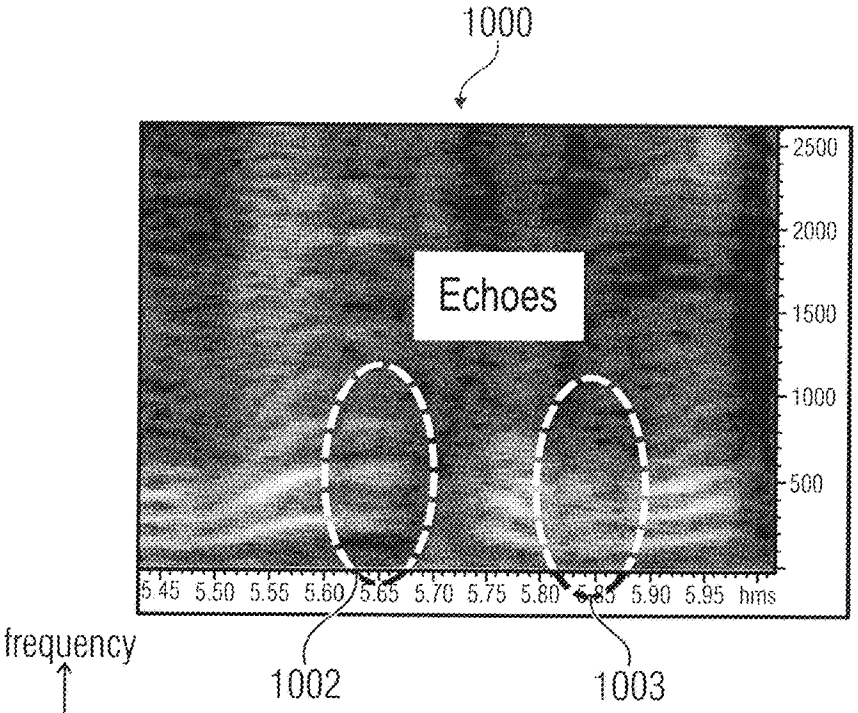

FIG. 10 shows a diagram 1000 with the spectral view of a signal in which some frames indicated by numerals 1002 and 1003 are concealed with a traditional technique. Even though in the previous properly decoded frame the speech has been terminated, an annoying echo is artificially construed.

Especially for speech or transient signals, a static damping factor is not sufficient. For example if the first lost frame is right after a word end, this will lead to annoying post echoes (see left figure below). To prevent this, the damping factor has to be adapted to the current signal. According to G.729.1 [3] and EVS [4], an adaptive fade out is proposed, which depends on the stability of the signal characteristics. Thus the factor depends on the parameters of the last good received superframe class and the number of consecutive erased superframes. The factor is further dependent on the stability of the LP filter for UNVOICED superframes. As there is no signal characteristics available in AAC decoders like AAC-ELD [5], the codec is damping the concealed signal blind with a fix factor, which can leads to the annoying repetition artefacts described above.

To solve the problem in an embodiment, the temporal energy trend value of the last synthesized good frame x (e.g., of a properly decoded audio frame) is observed, to calculate a new damping factor fac for the first lost frame. The energy level evolution over time in the last frame x is extrapolated to the following frame, which will determine the damping factor. Therefore, the damping factor is calculated by setting the energy of the last samples of x in relation to the energy of the full previous good frame x:

$$fac = \sqrt{\frac{4 \sum_{k=0.7 \cdot L}^{L} w_{k-0.7 \cdot L} \cdot x_k^2}{\sum_{k=1}^{L} x_k^2}}$$

where L is the frame length and $w_k$ is a modified hann window:

$$w_k = \begin{cases} 0.5 \cdot \left(1 - \cos\left(\frac{2\pi k}{0.2 \cdot L - 1}\right)\right), & 0 \le k < 0.1 \cdot L \\ 1, & k \ge 0.1 \cdot L \end{cases}$$

The shape of the window is designed in such a way, that $$\frac{4 \sum_{k=0.7 \cdot L}^{L} w_k}{L} = 1$$

In comparison to [1], where the static damping factor of 0.7071 will be applied to the whole spectrum, the calculated damping factor fac will be used if it is lower than the default value of 0.7071; otherwise, fac=0.7071 will be used. In some case we have some prior knowledge about the signal characteristics which can be the energy stability of a signal or a signal class saying if the signal has a voiced, noisy or onset characteristic. Then (for example, if t properly decoded audio frame preceding the lost audio frame is classified as noisy) it is sometimes beneficial to fade out slower, by using the calculated damping factor. For example if the signal is really noisy, we want to keep the energy constant, which helps especially for single frame loss. Finally, the damping factor may be maximized by 1, to prevent high-energy increase artefacts.

In the state of the art [1], the spectrum gets scaled by a constant factor of 0.7071 during multiple frame losses. In the inventive approach, the adaptive damping factor is only used in the first concealed frame. For consecutive frame loss, the damping factor of the current frame (fac) will be dependent on the previous one ($fac_{-1}$):

$$fac = fac_{-1} \cdot \begin{cases} 0.9, & nbLost == 2 \\ 0.75, & nbLost == 3 \\ 0.5, & nbLost == 4 \\ 0.2, & nbLost > 4 \end{cases}$$

where nbLost is the number of consecutive lost frames. This leads to less post echoes due to a faster fade out (or an index describing whether the current frame is the second, third, fourth, . . . , lost frame of a sequence of lost frames).

Figure 11:
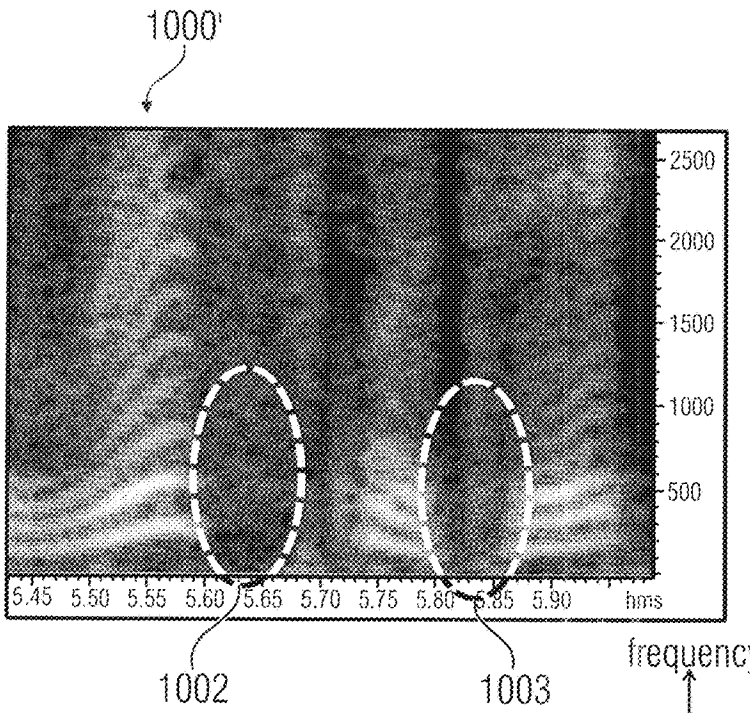
FIGS. 10-11 show comparative examples of signal diagrams.

As can be seen in FIG. 11, the areas 1002 and 1003 (which in known technology would have been affected by annoying echoes) have now been advantageously "polished".

Further Embodiments of the Present Disclosure

Figure 14:
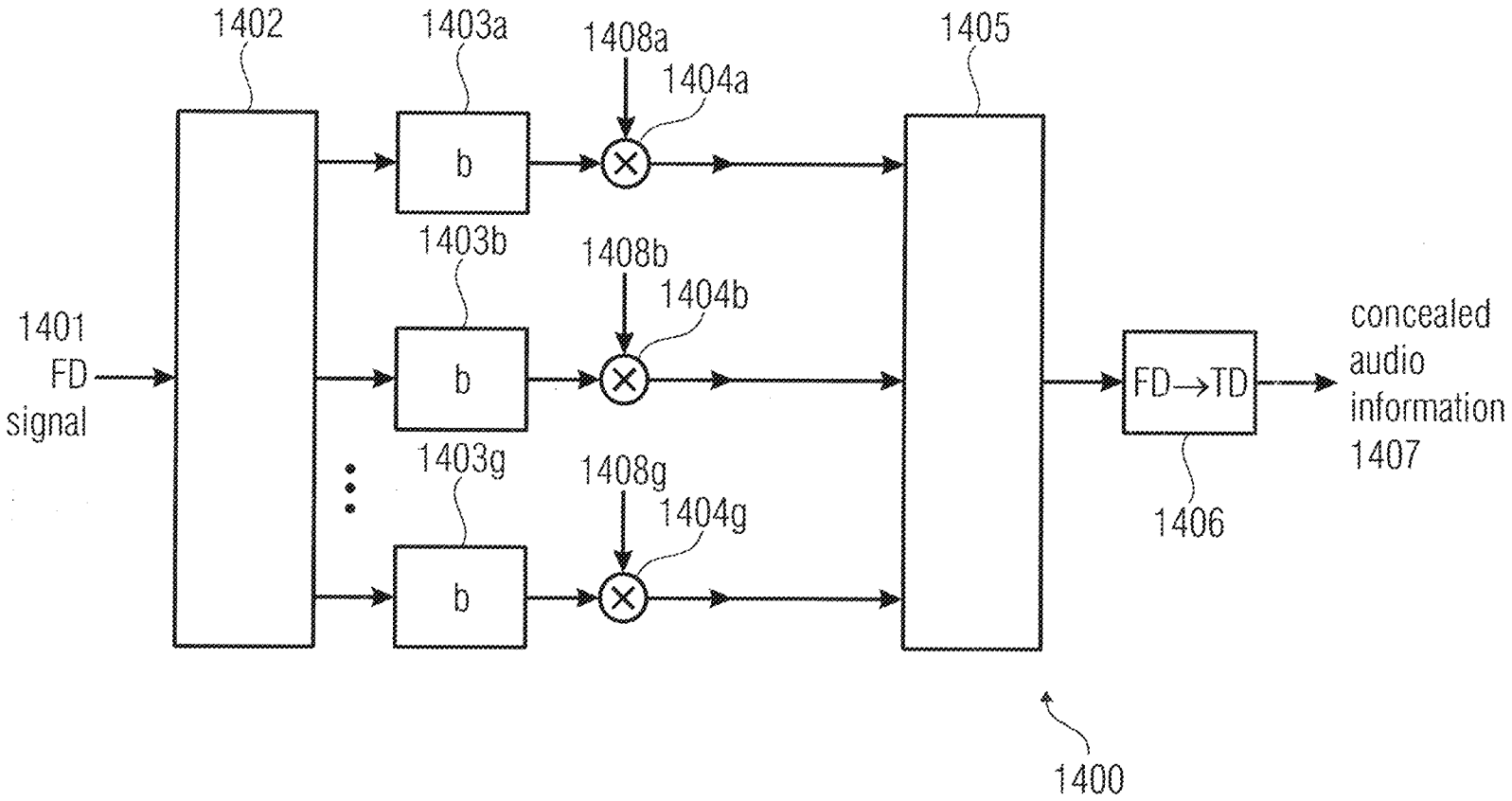
FIG. 14 shows embodiments of means used to calculate the damping factor according to an embodiment of the invention.

FIG. 14 shows an error concealment 1400 in which different frequency bands (or bins) of the same properly decoded audio frame are dampened differently. Although possible, it is not strictly necessary to embody FIG. 1 or 3 to embody FIG. 14.

With reference to FIGS. 2 and 4, an error concealment unit is obtained for the purpose of providing an error concealment audio information for concealing a loss of an audio frame in an encoded audio information. The error concealment unit is configured to provide an error concealment audio information based on a properly decoded audio frame preceding a lost audio frame. The error concealment unit is configured to perform a fade out using different damping factors for different frequency bands.

Different bins memorized in different memory portions (e.g., buffers) 405*a*, 405*b*, . . . , 405*g* are scaled by different damping factors 1408*a*, 1408*b*, . . . , 1408*g* (the damping factors multiplying the bin values at the scalers 407*a*, 407*b*, . . . , 407*g*), to obtain different bins memorized in different memory portions 406*a*, 406*b*, . . . , 406*g* of a concealment audio information.

According to one embodiment, it is possible to derive the different damping factors on the basis of characteristics of a spectral domain representation of the properly decoded audio frame preceding the lost audio frame.

FIG. 14 shows that the FD representation of a properly decoded audio frame is subdivided at block 1402 between different frequency bands 1403*a*, 1403*b*, . . . , 1403*g*. The one or more spectral bin values of each band are scaled at 1404*a*, 1404*b*, . . . , 1404*g*. Subsequently, the values of the bands are composed with each other and transformed at block 1406 (which can be the same of block 370 discussed above) and can be used as concealment audio information 1407.

Block 1402 does not exist in reality and, in a simple embodiment, only represents a logical grouping of spectral bin values. Similarly, block 1405 does not exist in reality, but represents a logical combination of modified (scaled) spectral values.

It is possible to adapt one or more damping factors, so as to fade out voiced frequency bands (or frequency bands having a comparatively high energy) of the properly decoded audio frame preceding the lost audio frame faster than non-voiced or noise-like frequency bands of the properly decoded audio frame preceding the lost audio frame.

According to one embodiment, it is possible to adapt the damping factors 1408*a*, 1408*b*, . . . , 1408*g*, so as to fade out one or more frequency bands (i.e., an $i^{th}$ band of the whole spectrum) of the properly decoded audio frame and having a comparatively higher energy per spectral bin faster than one or more frequency bands of the properly decoded audio frame preceding the lost audio frame and having a comparatively lower energy per spectral bin.

Figure 15B:
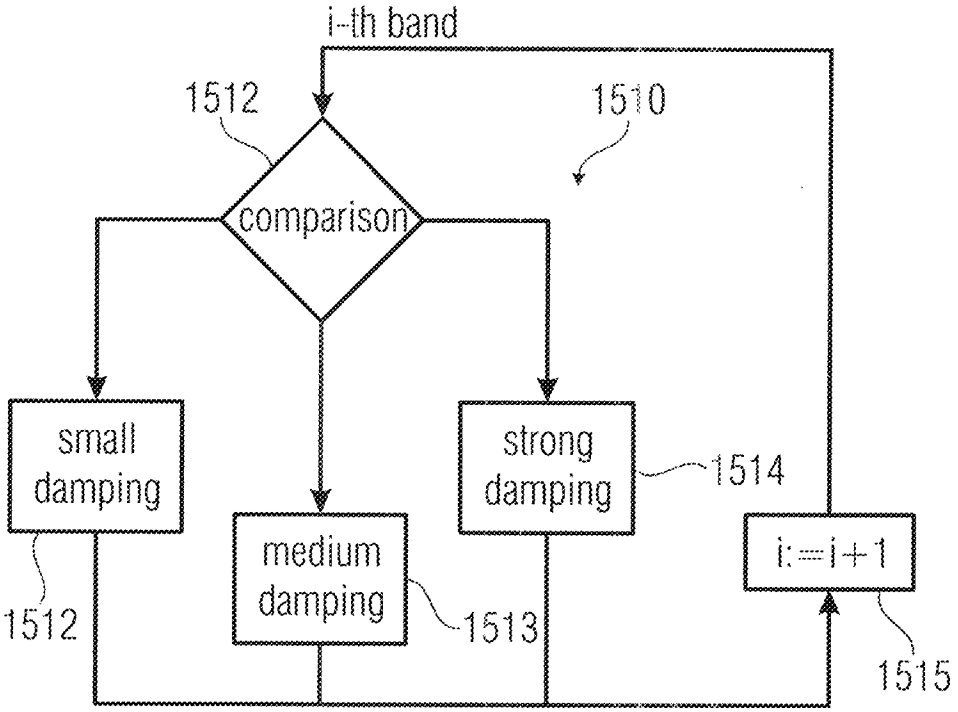
FIGS. 15(*a*)-15(*c*) show embodiments of means used to calculate the damping factor according to an embodiment of the invention.
Figure 15A:
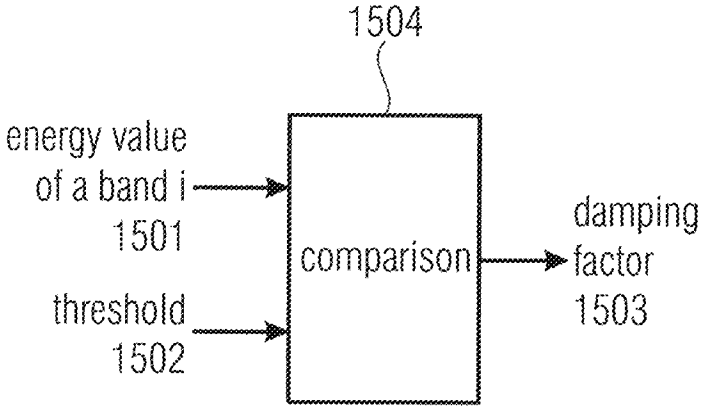
Figure 15C:
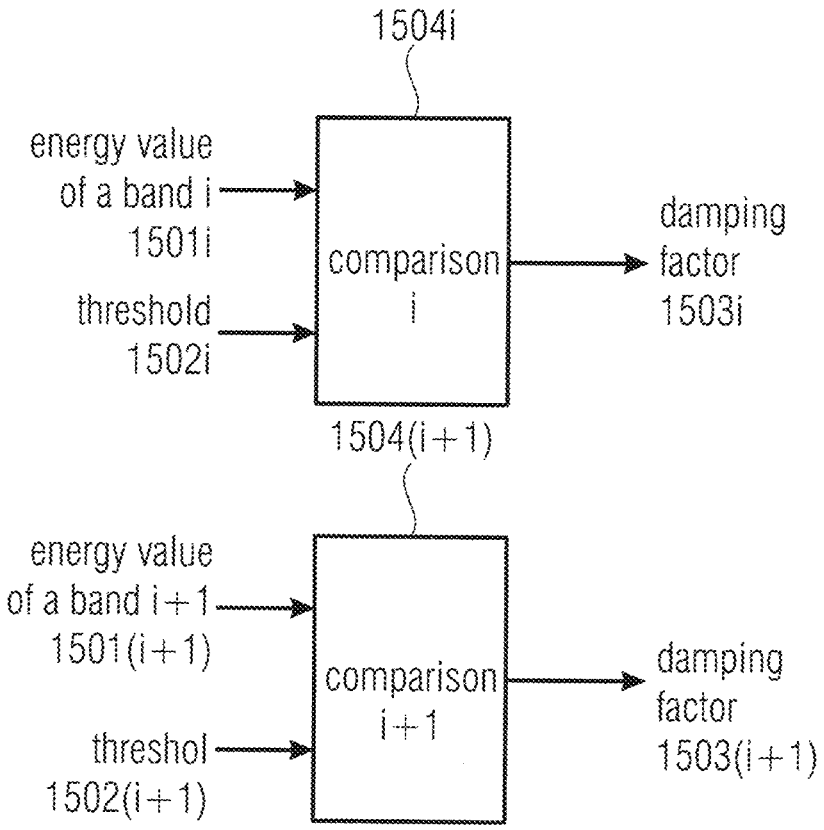

As can be seen in FIG. 15(*a*), at a comparison block 1504 it is possible to set a damping factor 1503, for at least one frequency band 1403*a*, 1403*b*, . . . , 1403*g*, on the basis of a comparison between an energy value 1501 associated to the at least one frequency band in the properly decoded audio frame and a threshold 1502.

According to one embodiment, it is possible to use a predetermined damping factor for the at least one frequency band if the energy value associated to the at least one frequency band is lower than the threshold. It is possible to use a damping factor which is smaller than a predetermined damping factor (which may, generally speaking, indicate a stronger damping or a faster fade out) for the at least one frequency band if the energy value associated to the at least one frequency band is higher than the threshold.

According to one embodiment, it is possible to use a damping factor representing a comparatively slower fade-out for the at least one frequency band if the energy value associated to the at least one frequency band is lower than the threshold. The error concealment unit can be configured to use a damping factor representing a comparatively faster fade-out for the at least one frequency band if the energy value associated to the at least one frequency band is higher than the threshold.

According to one embodiment, it is possible to define the damping factor as a predetermined value if the energy value associated to the at least one frequency band is lower than the threshold. If the energy value associated to the at least one frequency band is higher than the threshold, it is possible to derive the damping factor for the at least one frequency band on the basis of a temporal energy trend value of the decoded representation of the properly decoded audio frame preceding the lost audio frame, so as to fade out the at least one frequency band faster than where the energy value associated to the at least one frequency band is lower than the threshold.

FIG. 15(*b*) shows a determination 1510 carried out by comparing a value related to the energy of one band (e.g., an $i^{th}$ band of the spectrum of the properly decoded audio frame) with a threshold (e.g., threshold 1502). At 1511, a determination is performed. The determination can contemplate the calculation a temporal energy trend value in the $i^{th}$ frequency band according to one of the examples discussed above (see also FIGS. 5 and 8(*b*) above and the related passages in the description).

If it is recognized that the $i^{th}$ band of the properly decoded audio frame contains noise (e.g., the value related to the energy of the band is under the threshold), a small damping (or no damping at all) is carried out at 1512, for example by defining a damping factor at a value comprised between 0.95 and 1.

If it is recognized that the $i^{th}$ band contains speech but a word is not terminated in the properly decoded audio frame (or the energy decrease over time is smaller than a predetermined threshold), a reduced damping is carried out at 1513, for example by defining a damping factor 0.7071.

In particular, if it is recognized that the $i^{th}$ band of the properly decoded audio frame contains an element of speech terminating in the same frame, a strong damping is carried out at 1514. Where the temporal energy trend value is calculated as above (and the first and second portion of the frame are defined similarly to the embodiment of FIG. 6(*b*)), it is also possible to define the damping factor as being the same value (or a scaled value) of the energy trend value 801 for band i.

It is not necessary, however, to limit the invention to only two damping factors (as used at 1512 or 1513). It is also possible to define have more than two default factors: for example a value similar to 0.7071 as a medium damping (1513); 0.9 for lower bands; 0.95 for mid bands; 0.98 for higher bands as a small damping factor (1512), or 0.9 if signal class is VOICED and 0.95 if signal class is UNVOICED as a small damping factor (1512), etc . . . .

As can be seen in FIG. 15(*c*), it is possible to define different thresholds 1501*i*, 1501(*i*+1), etc., for different frequency bands i, i+1, etc., to obtain different damping factors 1503*i*, 1503(*i*+1), etc. An example is provided in FIG. 12, in which the threshold varies according to the frequency, implying that the values related to energy of different bands (or scale factor bands) are compared to different thresholds.

In particular, it is possible to set the threshold on the basis of an energy value, or an average energy value, or an expected energy value of the at least one frequency band.

According to one embodiment, it is possible to set the threshold on the basis of a ratio between an energy value of the properly decoded audio frame preceding the lost audio frame and a number of spectral lines in the whole spectrum of the properly decoded audio frame preceding the lost audio frame.

The threshold can be based on a temporal energy trend value of the decoded representation of the properly decoded audio frame preceding the lost audio frame.

The threshold for an i-th frequency band can be obtained using the formula:

$$\text{threshold}_i = \text{newEnergyPerLine} \cdot nb\text{OfLines}_i$$

where $\text{nbOfLines}_i$ is the number of lines in the i-th frequency band, wherein $$newEnergyPerLine = \frac{fac}{nbOfTotalLines} \cdot energy_{total}$$

The value fac represents the temporal energy trend value in the properly decoded audio frame preceding the lost audio frame, or a damping value derived from a quantity representing the temporal energy trend value in the properly decoded audio frame preceding the lost audio frame. The value $\text{energy}_{total}$ is a total energy over all frequency bands of the properly decoded audio frame preceding the lost audio frame. The value nbOfTotalLines is a total number of spectral lines of the properly decoded audio frame preceding the lost audio frame.

The bands can be scale factor bands, spectral values of which are scaled using different scale factors. Different scale factors for scaling inversely quantized spectral values are associated with different scale factor bands. It is possible to scale a spectral representation of the audio frame preceding the lost audio frame using the damping factors, in order to derive a concealed spectral representation of the lost audio frame.

It is possible to scale different frequency bands of a spectral representation of the audio frame preceding the lost audio frame using different damping factors, to thereby fade out the spectral values of the different frequency bands with different fade-out-speeds, in order to derive a concealed spectral representation of the lost audio frame.

Taking FIG. 15(*b*) as reference, it is possible, for each i-th band of the properly decoded frame:

at 1512, to set the damping factor associated to the i-th frequency band to a first predetermined value, which indicates a smaller damping than a second predetermined value, if at 1511 it is recognized, advantageously on the basis of a bitstream information or on the basis of a signal analysis, that the properly decoded audio frame preceding the lost audio frame is noise-like, and/or at 1513, to set the damping factor associated to the i-th frequency band to the second predetermined value, if at 1511 it is recognized, advantageously on the basis of a bitstream information or on the basis of a signal analysis, that the properly decoded audio frame preceding the lost audio frame is speech-like with the speech not ending in the properly decoded audio frame preceding the lost audio frame, and/or at 1514, to set the damping factor associated to the i-th frequency band to a value based on the energy trend value or a scaled version thereof, if at 1511 it is recognized, advantageously on the basis of a bitstream information or on the basis of a signal analysis, that the properly decoded audio frame preceding the lost audio frame is speech-like with the speech decaying or ending in the properly decoded audio frame preceding the lost audio frame;

at 1515, a new band i+1 is chosen, and the procedure above is repeated for the new band.

According to one embodiment, the error concealment unit is configured to compare an energy in a given i-th frequency band with a threshold (e.g. 1502), and the error concealment unit provides a scaling factor for the given i-th frequency band which is derived on the basis of a temporal energy trend value of the decoded representation of the properly decoded audio frame preceding the lost audio frame if the energy in the given i-th frequency band is larger than the threshold; and the error concealment unit sets the damping factor to a first predetermined value (e.g., at 1512), which indicates a smaller damping than a second predetermined value, if it is recognized, advantageously on the basis of a bitstream information or on the basis of a signal analysis, that the properly decoded audio frame preceding the lost audio frame is recognized as noise-like, and if the energy in the given i-th frequency band is smaller than the threshold; and/or the error concealment unit is configured to set the damping factor to the second predetermined value, if the properly decoded audio frame preceding the lost audio frame is recognized, advantageously on the basis of a bitstream information or on the basis of a signal analysis, as being not noise-like.

According to one embodiment, the error concealment unit performs a spectral-domain-to-time-domain transform (e.g. at 1406), in order to obtain a decoded representation (e.g. 1407) of a properly decoded audio frame preceding the lost audio frame.

Figure 16A:
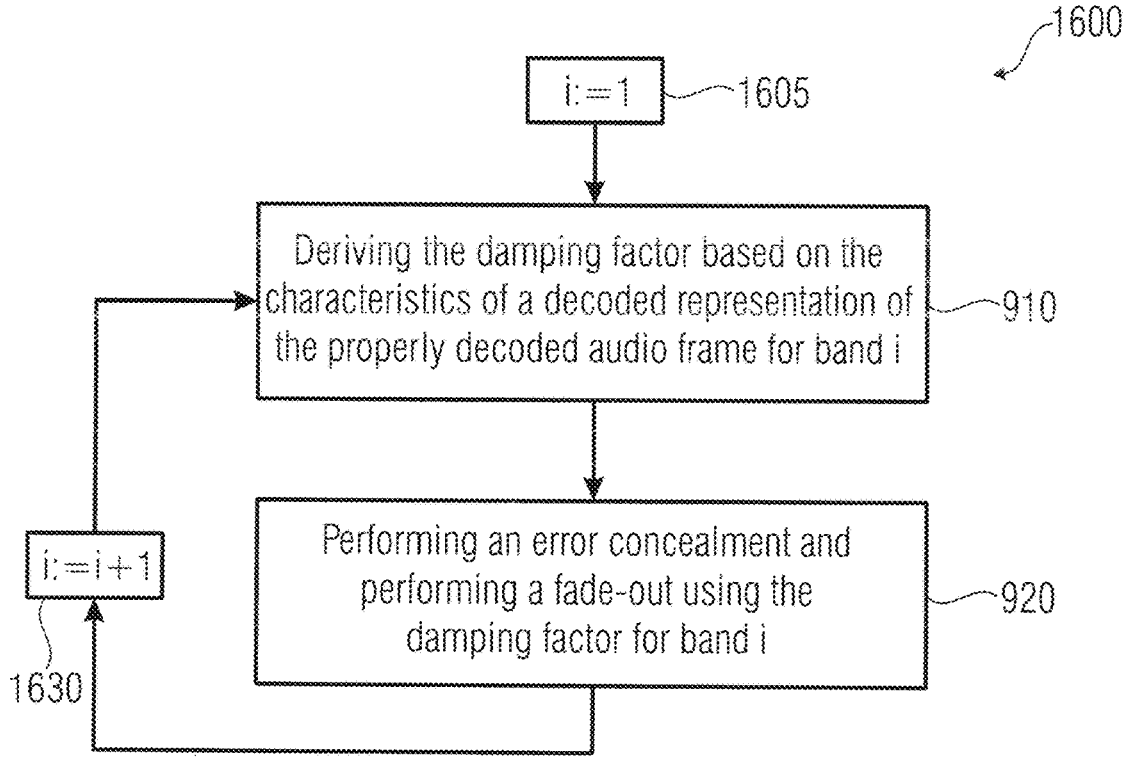
FIGS. 16(*a*)-16(*b*) show embodiments of inventive concealing methods.
Figure 16B:
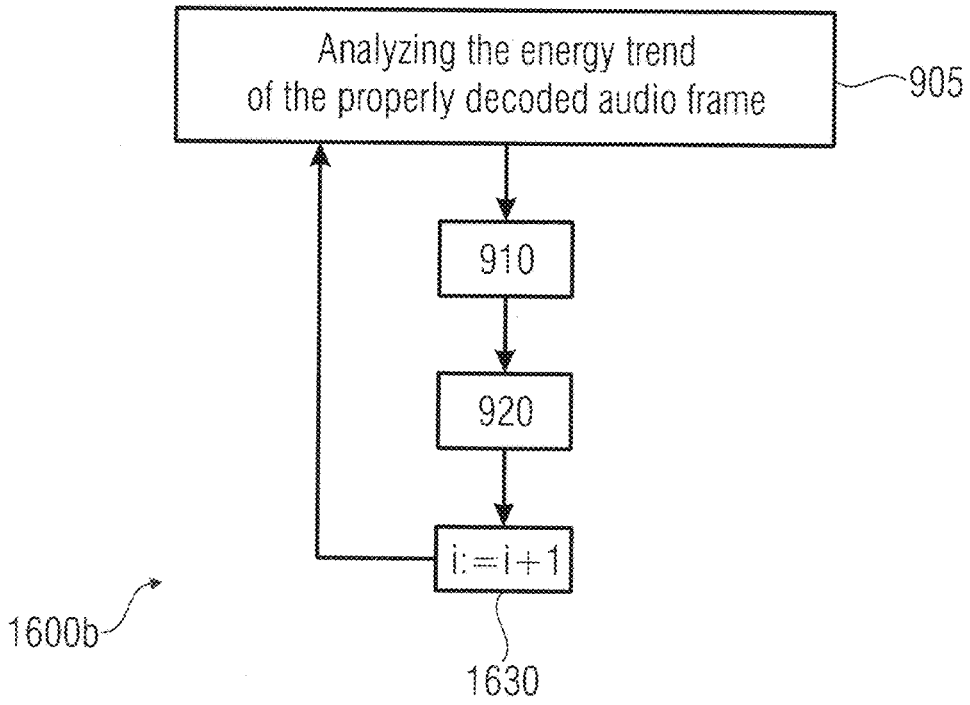

FIG. 16(*a*) shows an error concealment method 1600 for providing an error concealment audio information for concealing a loss of an audio frame in an encoded audio information, in which a spectral representation of a properly decoded audio frame is subdivided into 1, 2, . . . , i, etc., bands, the method comprising the following steps:

at 1605, choosing a first band 1 (e.g., i:=1);

at 910, deriving a damping factor on the basis of characteristics of a decoded representation of a properly decoded audio frame preceding the lost audio frame for band i;

at 920, performing a fade out using the damping factor for band i;

at 1630, choosing a new band i+1;

repeating this proceeding for all the bands of the spectral view of the properly decoded audio frame.

FIG. 16(*b*) shows a variant 1600*b* in which, before step 910 (see FIG. 16(*a*)), a step 905 is performed in which the energy trend value of the properly decoded audio frame is analyzed.

In methods 1600 and 1600*b*, reference numerals of methods 900 and 900*b* are maintained to permit to appreciate the similarity between the different embodiments of the method.

Operation of an Embodiment of the Invention and Experimental Results

According to an aspect of the invention, it is here found that it is advantageous to fade out a concealed frame by fading out different bands of a signal using different damping factors.

It has been found that it is not always desirable to damp every part of the signal with the same speed. For example in case of speech with background noise we wish to fade out the voiced part of the signal without fading out too much the background noise to avoid annoying artifacts coming from holes in the spectrum. Therefore the damping factor is applied differently on different frequency regions of the signal in some embodiments. This could be done based on LPC or scale factors.

Figure 12:
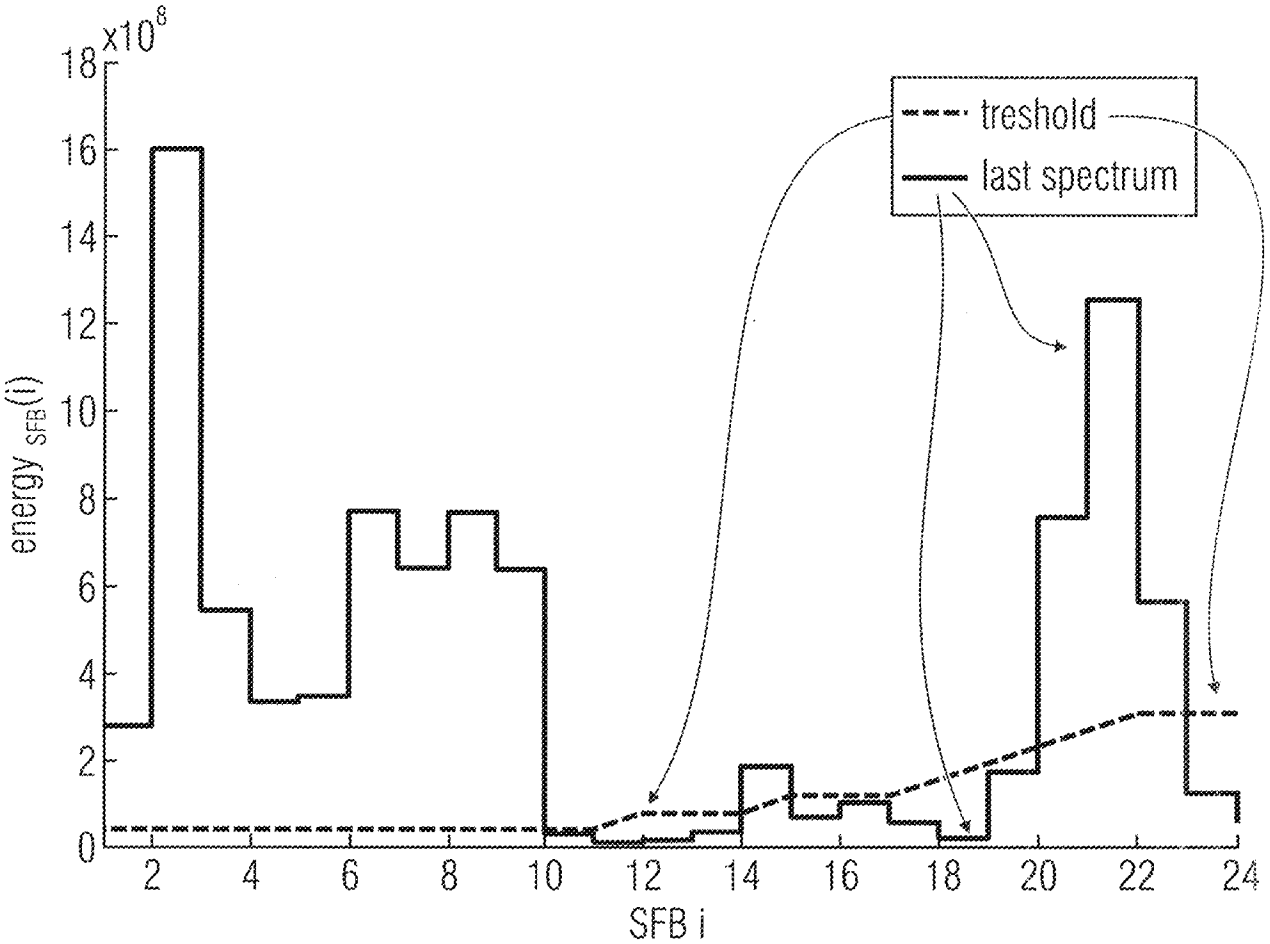
FIG. 12 shows an example of definition of thresholds according to an embodiment of the invention.

One application is a scale factor band dependent damping explained below (see also FIG. 12).

In order to prevent energy gaps/spectral holes in low energy scale factor bands (SFBs), which can appear in the state of the art method, the damping factor will be applied scale factor band wise. If the energy of a SFB is higher than a certain threshold, the adapted damping factor fac (which can be obtained, for example, as described in section 5.7) will be used. Otherwise, the default damping factor of 0.7071 ($\frac{1}{2}^{1/2}$) will be applied (see, for example, FIG. 12). In some cases it is beneficial to fade out the SFBs, which are lower than the threshold, even slower; so that those parts are not becoming zero, which means that the signal is fading towards a fading out white noise.

The threshold may, for example, depend on the number of lines in each band. This means, for the SFB i the threshold is:

$$\text{threshold}_i = \text{newEnergyPerLine} \cdot nb\text{OfLines}_i$$

where $\text{nbOfLines}_i$ are the number of lines in the i-th SFB and $$newEnergyPerLine = \frac{fac}{nbOfTotalLines} \cdot energy_{total}$$

where nbOfTotalLines are the number of total lines in the whole spectrum and $\text{energy}_{total}$ is the total energy over all SFBs.

Figures 13A, 13B:
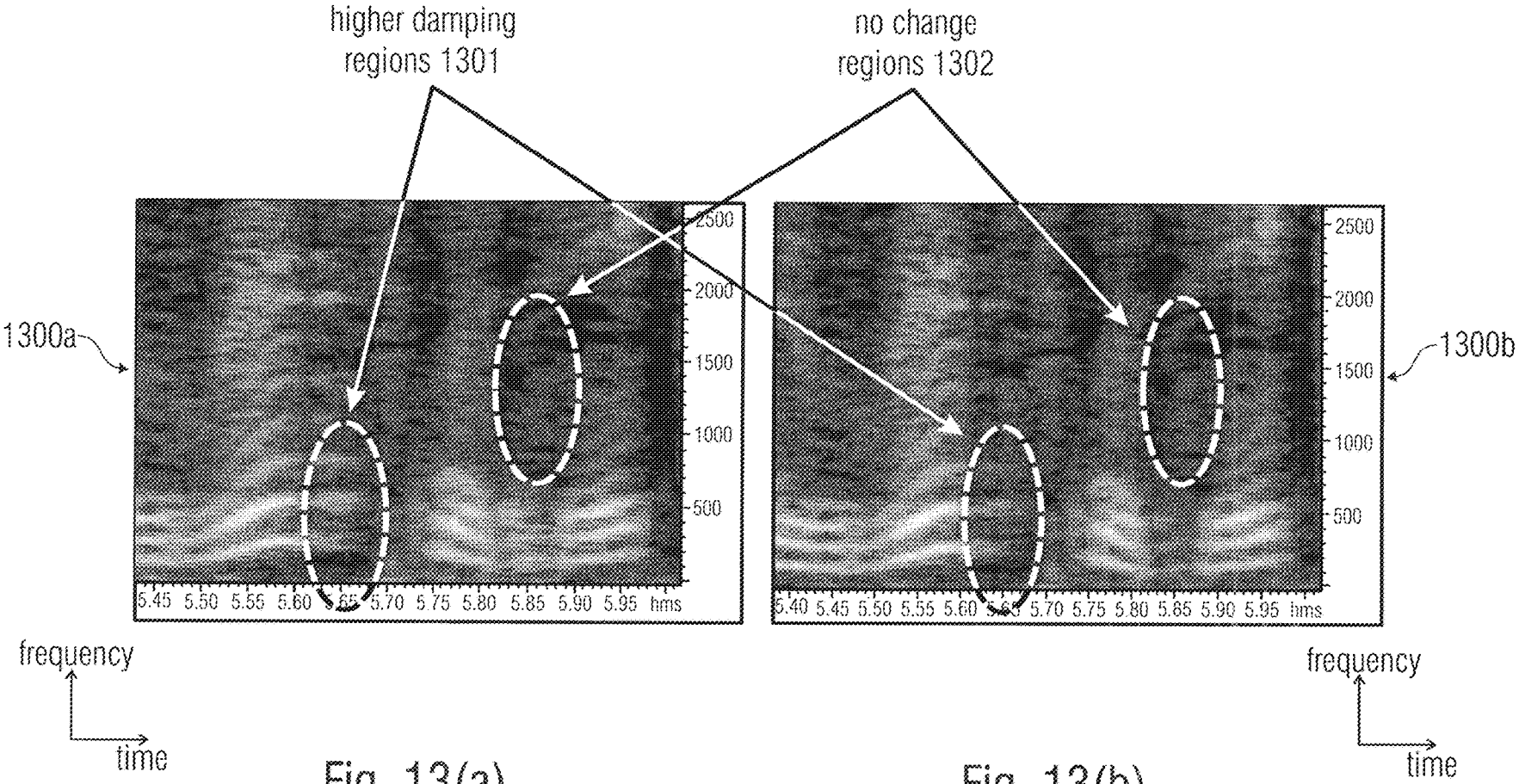
FIGS. 13(*a*)-13(*b*) show comparative examples of signal diagrams.

An example can be provided by the results of FIGS. 13(*a*) and (*b*) (ordinate: time in hundred ms or hms; abscissa: frequency), in which a graph 1300*a* of a non-damped signal is compared to a graph 1300*b* of a damped signal. Higher-damping regions 1301 (mostly speech, in particular frames in which speech has terminated) are shown in counter position to no-change regions 1302 (mostly non-dampened noise). In particular, the higher-damping region 1301 that would occur in FIG. 13(*a*) is appropriately dampened in FIG. 13(*b*), hence, reducing annoying echoes. To the contrary, noise of regions 1302 is not dampened, as of advantage.

Conclusions

An adaptive fade-out for packet loss concealment in frequency domain audio codecs is described.

In case of packet losses, speech and audio codecs usually fade towards zero or background noise to prevent annoying repetition artifacts. For all AAC family decoders the concealed spectrum is faded out with a constant damping factor regardless on the signal characteristics. Especially for speech or transient signals, a static damping factor may not be sufficient. Thus, embodiments according to the invention calculate an adaptive damping factor dependent on the temporal energy trend value of the last good frame. Furthermore, a frequency adaptive damping is applied on the concealed spectrum to avoid annoying holes in the spectrum.

Embodiments can be used, for example, in the technical fields ELD, XLD, DRM or MPEG-H, for example in combination with audio decoders of that kind.

Additional Remarks

In case of packet losses, speech and audio codecs usually fades towards zero or background noise to prevent annoying repetition artefacts.

For all AAC family decoders the concealed spectrum is faded out with a constant damping factor regardless on the signal characteristics.

Especially for speech or transient signals, a static damping factor is not sufficient.

Thus, a tool is provided for calculating an adaptive damping factor, dependant on the temporal energy trend of the last good frame.

Furthermore, a frequency adaptive damping is applied on the concealed spectrum to avoid annoying holes in the spectrum.

Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

BIBLIOGRAPHY

[1] 3GPP TS 26.402 "Enhanced aacPlus general audio codec; Additional decoder tools (Release 11)",

[2] J. Lecomte, et al, "Enhanced time domain packet loss concealment in switched speech/audio codec", submitted to IEEE ICASSP, Brisbane, Australia, April 2015.

[3] WO 2015063045 A1

[4] "Apparatus and method for improved concealment of the adaptive codebook in ACELP-like concealment employing improved pitch lag estimation", 2014, PCT/EP2014/062589

[5] "Apparatus and method for improved concealment of the adaptive codebook in ACELP-like concealment employing improved pulse "synchronization", 2014, PCT/EP2014/062578

What is claimed is:

1. An error concealment unit for providing an error concealment audio information for concealing a loss of an audio frame in an encoded audio information, wherein the error concealment unit is configured to provide an error concealment audio information based on a properly decoded audio frame preceding a lost audio frame, wherein the error concealment unit is configured to perform a fade out using different damping factors for different frequency bands of the properly decoded audio frame preceding the lost audio frame, wherein the error concealment unit is configured to adapt one or more damping factors, so as to fade out one or more frequency bands of the properly decoded audio frame preceding the lost audio frame and comprising a comparatively higher energy per spectral bin faster than one or more frequency bands of the properly decoded audio frame preceding the lost audio frame and comprising a comparatively lower energy per spectral bin.

2. The error concealment unit according to claim 1, wherein the error concealment unit is configured to derive the damping factors on the basis of characteristics of a spectral domain representation of the properly decoded audio frame preceding the lost audio frame.

3. The error concealment unit according to claim 1, wherein the error concealment unit is configured to adapt one or more damping factors, so as to fade out voiced frequency bands of the properly decoded audio frame preceding the lost audio frame faster than non-voiced or noise-like frequency bands of the properly decoded audio frame preceding the lost audio frame.

4. The error concealment unit according to claim 1, wherein the error concealment unit is configured to set a damping factor, for at least one frequency band, on the basis of a comparison between an energy value associated to the at least one frequency band in the properly decoded audio frame preceding the lost audio frame and a threshold.

5. The error concealment unit according to claim 4, wherein the error concealment unit is configured to use a predetermined damping factor for the at least one frequency band if the energy value associated to the at least one frequency band is lower than the threshold, and/or wherein the error concealment unit is configured to use a damping factor which is smaller than a predetermined damping factor for the at least one frequency band if the energy value associated to the at least one frequency band is higher than the threshold.

6. The error concealment unit according to claim 4, wherein the error concealment unit is configured to use a damping factor representing a comparatively slower fade-out for the at least one frequency band if the energy value associated to the at least one frequency band is lower than the threshold, and/or wherein the error concealment unit is configured to use a damping factor representing a comparatively faster fade-out for the at least one frequency band if the energy value associated to the at least one frequency band is higher than the threshold.

7. The error concealment unit according to claim 4, wherein the error concealment unit is configured to define the damping factor as a predetermined value if the energy value associated to the at least one frequency band is lower than the threshold, wherein the error concealment unit is configured, if the energy value associated to the at least one frequency band is higher than the threshold, to derive the damping factor for the at least one frequency band on the basis of a temporal energy trend of the decoded representation of the properly decoded audio frame preceding the lost audio frame, so as to fade out the at least one frequency band faster than where the energy value associated to the at least one frequency band is lower than the threshold.

8. The error concealment unit according to claim 4, wherein the error concealment unit is configured to define different thresholds for different frequency bands.

9. The error concealment unit according to claim 5, wherein the error concealment unit is configured to set the threshold on the basis of an energy value, or an average energy value, or an expected energy value of the at least one frequency band.

10. The error concealment unit according to claim 4, wherein the error concealment unit is configured to set the threshold on the basis of a ratio between an energy value of the properly decoded audio frame preceding the lost audio frame and a number of spectral lines in the at least one frequency band of the properly decoded audio frame preceding the lost audio frame.

11. The error concealment unit according to claim 4, wherein the error concealment unit is configured to set the threshold on the basis of a temporal energy trend of the decoded representation of the properly decoded audio frame preceding the lost audio frame.

12. The error concealment unit according to claim 4, wherein the error concealment unit is configured to set the threshold for an i-th frequency band using the formula:

$$\text{threshold}_i = \text{newEnergyPerLine} \cdot nb\text{OfLines}_i$$

where $\text{nbOfLines}_i$ is the number of lines in the i-th frequency band, wherein $$newEnergyPerLine = \frac{fac}{nbOfTotalLines} \cdot energy_{total}$$

wherein fac is a quantity representing the temporal energy trend in the properly decoded audio frame preceding the lost audio frame, or a damping value derived from a quantity representing the temporal energy trend in the properly decoded audio frame preceding the lost audio frame;

wherein $energy_{total}$ is a total energy over all frequency bands of the properly decoded audio frame preceding the lost audio frame; and wherein nbOfTotalLines is a total number of spectral lines of the properly decoded audio frame preceding the lost audio frame.

13. The error concealment unit according to claim 1, wherein the error concealment unit is configured to perform a fade out using different damping factors for different scale factor bands, wherein different scale factors for scaling inversely quantized spectral values are associated with different scale factor bands.

14. The error concealment unit according to claim 1, wherein the error concealment unit is configured to scale a spectral representation of the audio frame preceding the lost audio frame using the damping factors, in order to derive a concealed spectral representation of the lost audio frame.

15. The error concealment unit according to claim 1, wherein the error concealment unit is configured to scale different frequency bands of a spectral representation of the audio frame preceding the lost audio frame using different damping factors, to thereby fade out the spectral values of the different frequency bands with different fade-out-speeds, in order to derive a concealed spectral representation of the lost audio frame.

16. The error concealment unit according to claim 1, wherein the error concealment unit is configured:

to set the damping factor associated to a given frequency band to a first predetermined value, which indicates a smaller damping than a second predetermined value, if it is recognized, advantageously on the basis of a bitstream information or on the basis of a signal analysis, that the properly decoded audio frame preceding the lost audio frame is noise-like, and/or to set the damping factor associated to the given frequency band to the second predetermined value, if it is recognized, advantageously on the basis of a bitstream information or on the basis of a signal analysis, that the properly decoded audio frame preceding the lost audio frame is speech-like with the speech not ending in the properly decoded audio frame preceding the lost audio frame, and/or to set the damping factor associated to the given frequency band to a value based on the energy trend value or a scaled version thereof, if it is recognized, advantageously on the basis of a bitstream information or on the basis of a signal analysis, that the properly decoded audio frame preceding the lost audio frame is speech-like with the speech decaying or ending in the properly decoded audio frame preceding the lost audio frame.

17. The error concealment unit according to claim 1, wherein the error concealment unit is configured to compare an energy in a given frequency band with a threshold, and wherein the error concealment unit is configured to provide a scaling factor for the given frequency band which is derived on the basis of a temporal energy trend of the decoded representation of the properly decoded audio frame preceding the lost audio frame if the energy in the given frequency band is larger than the threshold; and wherein the error concealment unit is configured to set the damping factor to a first predetermined value, which indicates a smaller damping than a second predetermined value, if it is recognized, advantageously on the basis of a bitstream information or on the basis of a signal analysis, that the properly decoded audio frame preceding the lost audio frame is recognized as noise-like, and if the energy in the given frequency band is smaller than the threshold; and/or wherein the error concealment unit is configured to set the damping factor to the second predetermined value, if the properly decoded audio frame preceding the lost audio frame is recognized, advantageously on the basis of a bitstream information or on the basis of a signal analysis, as being not noise-like.

18. The error concealment unit according to claim 1, wherein the error concealment unit is configured to perform a spectral-domain-to-time-domain transform, in order to acquire a decoded representation of a properly decoded audio frame preceding the lost audio frame.

19. The error concealment unit according to claim 1, wherein the error concealment unit is configured to provide an error concealment audio information using a frequency domain concealment based on a properly decoded audio frame preceding a lost audio frame.

20. The error concealment unit according to claim 1, wherein the error concealment unit is configured to use a frequency domain representation of said properly decoded audio frame.

21. The error concealment unit according to claim 1, wherein the error concealment unit is configured to set a damping factor, for at least one frequency band, on the basis of a comparison between a threshold and an energy value associated to the at least one frequency band in the properly decoded audio frame.

22. The error concealment unit according to claim 1, wherein the error concealment unit is configured to set a default damping factor as a consequence of the threshold being higher than the energy value associated to the at least one frequency band.

23. The error concealment unit according to claim 1, wherein the damping factor is comprised between 0.95 and 1.

24. The error concealment unit according to claim 22, wherein the damping factor is comprised between 0.6 and 0.8.

25. The error concealment unit according to claim 1, wherein the error concealment unit is configured to set a damping factor adapted to the at least one frequency band and lower than the default damping factor as a consequence of the threshold being lower than the energy value associated to the at least one frequency band.

26. The error concealment unit according to claim 21, wherein the error concealment unit is configured to set the threshold, for at least one frequency band, on the basis of at least one or a combination of the following parameters:

the number of frequency lines in the frequency band;

an average energy for each line averaged for the whole frame; and the previously calculated damping factor for the frequency band.

27. The error concealment unit according to claim 26, wherein the error concealment unit is configured to set the threshold to be proportional to at least one of said parameters.

28. The error concealment unit according to claim 1, wherein the error concealment unit is configured to set, for at least one frequency band, the damping factor on the basis of characteristics of a time domain representation of the properly decoded audio frame.

29. The error concealment unit according to claim 28, wherein the error concealment unit is configured to define the damping factor on the basis of the temporal energy trend of the time domain representation of the properly decoded audio frame.

30. The error concealment unit according to claim 28, wherein said characteristics comprise a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group.

31. The error concealment unit according to claim 28, wherein the error concealment unit is configured to fade out at least one of subsequent concealed audio frames by reducing the damping factor with respect to the previous concealed audio frame.

32. The error concealment unit according to claim 1, wherein the frequency bands are scale factor bands, spectral values of which are scaled using different scale factors.

33. An audio decoder for providing a decoded audio information on the basis of encoded audio information, the audio decoder comprising an error concealment unit according to claim 1.

34. The audio decoder according to claim 33, wherein the audio decoder is configured to scale spectral values of different scale factor bands of a spectral representation of the audio frame preceding the lost audio frame using different scale factors.

35. A method for providing an error concealment audio information for concealing a loss of an audio frame in an encoded audio information, the method comprising:

providing an error concealment audio information based on a properly decoded audio frame preceding a lost audio frame; and performing a fade out using different damping factors for different frequency bands of the properly decoded audio frame preceding the lost audio frame, so as to fade out one or more frequency bands of the properly decoded audio frame preceding the lost audio frame and comprising a comparatively higher energy per spectral bin faster than one or more frequency bands of the properly decoded audio frame preceding the lost audio frame and comprising a comparatively lower energy per spectral bin.

36. A non-transitory digital storage medium having stored thereon a computer program for performing a method for providing an error concealment audio information for concealing a loss of an audio frame in an encoded audio information, the method comprising:

providing an error concealment audio information based on a properly decoded audio frame preceding a lost audio frame; and performing a fade out using different damping factors for different frequency bands of the properly decoded audio frame preceding the lost audio frame, so as to fade out one or more frequency bands of the properly decoded audio frame preceding the lost audio frame and comprising a comparatively higher energy per spectral bin faster than one or more frequency bands of the properly decoded audio frame preceding the lost audio frame and comprising a comparatively lower energy per spectral bin, when said computer program is run by a computer.

37. A method for providing an error concealment audio information for concealing a loss of an audio frame in an encoded audio information, the method comprising:

performing a frequency domain concealment to provide an error concealment audio information component;

fading out the concealed audio frames according to different damping factors for different frequency bands of the properly decoded audio frame preceding the lost audio frame, so as to fade out one or more frequency bands of the properly decoded audio frame preceding the lost audio frame and comprising a comparatively higher energy per spectral bin faster than one or more frequency bands of the properly decoded audio frame preceding the lost audio frame and comprising a comparatively lower energy per spectral bin.

38. An error concealment unit for providing an error concealment audio information for concealing a loss of an audio frame in an encoded audio information, wherein the error concealment unit is configured to provide an error concealment audio information based on a properly decoded audio frame preceding a lost audio frame, wherein the error concealment unit is configured to perform a fade out using different damping factors for different frequency bands of the properly decoded audio frame preceding the lost audio frame, wherein the error concealment unit is configured to set, for at least one frequency band, the damping factor on the basis of characteristics of a time domain representation of the properly decoded audio frame, wherein said characteristics comprise a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group.

39. A method for providing an error concealment audio information for concealing a loss of an audio frame in an encoded audio information, the method comprising:

providing an error concealment audio information based on a properly decoded audio frame preceding a lost audio frame; and performing a fade out using different damping factors for different frequency bands of the properly decoded audio frame preceding the lost audio frame, further comprising setting, for at least one frequency band, the damping factor on the basis of characteristics of a time domain representation of the properly decoded audio frame, wherein said characteristics comprise a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group.

40. A method for providing an error concealment audio information for concealing a loss of an audio frame in an encoded audio information, the method comprising:

performing a frequency domain concealment to provide an error concealment audio information component;

fading out the concealed audio frames according to different damping factors for different frequency bands of the properly decoded audio frame preceding the lost audio frame, further comprising setting, for at least one frequency band, the damping factor on the basis of characteristics of a time domain representation of the properly decoded audio frame, wherein said characteristics comprise a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group.

41. A non-transitory digital storage medium having stored thereon a computer program for performing a method for providing an error concealment audio information for concealing a loss of an audio frame in an encoded audio information, the method comprising:

performing a frequency domain concealment to provide an error concealment audio information component; and fading out the concealed audio frames according to different damping factors for different frequency bands of the properly decoded audio frame preceding the lost audio frame, so as to fade out one or more frequency bands of the properly decoded audio frame preceding the lost audio frame and comprising a comparatively higher energy per spectral bin faster than one or more frequency bands of the properly decoded audio frame preceding the lost audio frame and comprising a comparatively lower energy per spectral bin, when said computer program is run by a computer.

42. A non-transitory digital storage medium having stored thereon a computer program for performing a method for providing an error concealment audio information for concealing a loss of an audio frame in an encoded audio information, the method comprising:

providing an error concealment audio information based on a properly decoded audio frame preceding a lost audio frame; and performing a fade out using different damping factors for different frequency bands of the properly decoded audio frame preceding the lost audio frame, further comprising setting, for at least one frequency band, the damping factor on the basis of characteristics of a time domain representation of the properly decoded audio frame, wherein said characteristics comprise a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group, when said computer program is run by a computer.

43. A non-transitory digital storage medium having stored thereon a computer program for performing a method for providing an error concealment audio information for concealing a loss of an audio frame in an encoded audio information, the method comprising:

performing a frequency domain concealment to provide an error concealment audio information component; and fading out the concealed audio frames according to different damping factors for different frequency bands of the properly decoded audio frame preceding the lost audio frame, further comprising setting, for at least one frequency band, the damping factor on the basis of characteristics of a time domain representation of the properly decoded audio frame, wherein said characteristics comprise a term which keeps in account energy levels of a first group of samples of the properly decoded audio frame in respect of energy levels of a second group of samples of the same properly decoded audio frame, wherein at least one first group sample is subsequent of all the second group samples, and/or wherein at least one first group sample precedes all the second group samples, and/or wherein the time average of the first group precedes the time average of the second group, when said computer program is run by a computer.

* * * * *